US006445150B1

(12) United States Patent
Tanner et al.

(10) Patent No.: US 6,445,150 B1
(45) Date of Patent: Sep. 3, 2002

(54) SOFTWARE-DRIVEN MOTOR AND SOLENOID CONTROLLER

(76) Inventors: Christopher Mark Tanner, 1201 S. Eads St., #1811, Crystal City, VA (US) 22202-2845; Todd M. Halvorson, 1631 SE. 13th St., Ft. Lauderdale, FL (US) 33316

( * ) Notice: Subject to any disclaimer, the term of this patent is extended or adjusted under 35 U.S.C. 154(b) by 0 days.

(21) Appl. No.: 09/667,633

(22) Filed: Sep. 22, 2000

(51) Int. Cl.[7] ..... H02P 3/00; H02P 5/00; H02P 7/00

(52) U.S. Cl. ..... 318/280; 318/282; 318/286; 104/DIG. 1; 246/4; 246/246

(58) Field of Search ..... 318/138, 280, 318/281–293, 256; 307/116; 104/DIG. 1, 276, 301; 246/4, 246, 191, 187 A, 219, 220, 415 A; 340/825.21, 310 R

(56) References Cited

U.S. PATENT DOCUMENTS

| | | | | | |
|---|---|---|---|---|---|
| 3,829,682 | A | | 8/1974 | Geiger | |
| 4,122,523 | A | * | 10/1978 | Morse et al. | 246/473.2 |
| 4,147,939 | A | * | 4/1979 | Russell | |
| 4,307,302 | A | * | 12/1981 | Russell | |
| 4,335,381 | A | * | 6/1982 | Palmer | |
| 4,355,776 | A | * | 10/1982 | Rydin | |
| 4,853,883 | A | * | 8/1989 | Nickles et al. | 348/121 |
| 5,251,856 | A | * | 10/1993 | Young et al. | |
| 5,448,142 | A | | 9/1995 | Severson | |
| 5,456,604 | A | * | 10/1995 | Olmsted et al. | |
| 5,492,290 | A | * | 2/1996 | Quinn et al. | |
| 5,493,642 | A | * | 2/1996 | Dunsmuir et al. | 345/700 |
| 5,590,856 | A | * | 1/1997 | Quinn et al. | |
| 5,638,522 | A | * | 6/1997 | Dunsmuir et al. | 345/763 |
| 5,749,547 | A | | 5/1998 | Young et al. | |
| 5,752,678 | A | * | 5/1998 | Riley | |
| 5,775,524 | A | * | 7/1998 | Dunham | |
| 5,896,017 | A | * | 4/1999 | Severson et al. | |
| 6,123,298 | A | * | 9/2000 | Riley | |
| 6,281,606 | B1 | * | 8/2001 | Westlake | |

OTHER PUBLICATIONS

Digitrax model train product descriptions (5 pages), Mar. 9, 2000.
Lenz Electronic GmbH's "Digital Plus" product description (3 pages), Mar. 10, 2000.
Signal Research's "Roadmaster" product description (6 pages), May 2000.
Marklin Trains "Getting Started" product description (2 pages), May 2000.
Fairchild Semiconductor's MM74HC154 spec sheet (9 pages), Jun. 2000.
Dallas Semiconductor's DS1867 spec sheet (14 pages), Oct. 1999.
Allegro Microdevice's 3952 Motor Driver spec sheet (2 pages), Apr. 2000.
Texas Instrument's IPIC6B595 spec sheet (9 pages), May 2000.

* cited by examiner

*Primary Examiner*—Marlon T. Fletcher
(74) *Attorney, Agent, or Firm*—Christopher Mark Tanner, Esq.

(57) ABSTRACT

An apparatus and method for controlling electrical devices such as electric trains using a computer is disclosed. The invention utilizes standard ports that appear on most computers, and works with standard well-known widely commercially available train sets. The invention has customized software and circuitry for managing the speed and direction of one or more motors, and also for controlling the configuration of track turnouts. The invention can also be configured and updated by the user to fit the characteristics of a user's specific layout.

27 Claims, 24 Drawing Sheets

SOFTWARE-DRIVEN MOTOR AND SOLENOID CONTROLLER

FIELD OF THE INVENTION

The present invention relates to the field of controlling analog electrical devices, such as those commonly used in the hobbyist realm including electric trains. Specifically, the present invention relates to controlling various electrical devices using a computer having either a standard parallel port or a standard joystick/game/MIDI port.

BACKGROUND OF THE INVENTION

Many people have personal computers (PS), and many people have electric train layouts. Often, the two are in the same room. But few have found any way to conveniently, inexpensively operate the electric trains using those computers. Other attempts to electronically control the operation of electric train layouts have involved expensive and complicated modifications to engine (cab) motors including the addition of wireless transmitter/receivers to the engine motors. Such arrangements can also require the purchase of a separate, proprietary microcomputer or control device. Thus, these products are not only cost-prohibitive, but entail substantial modification to the electric train setup, and may require a high level of technical sophistication and interest to effectively implement their use.

Some examples of commercially available model railroad controller products include Digitrax, Digital Plus by Lenz Electronik, Roadmaster Train Controller by Signal Research, and the Marklin™ Delta Train controller. Other systems for electronically controlling model trains are disclosed in the following U.S. Pat. Nos. : 3,829,682; 4,349,196; 5,441,223; 5,448.142; 5,541,832; 5,638,522; and 5,749,547.

However, in all of the above configurations, none of the devices exploit the convenience and utility of a standalone PC conveniently located nearby the train layout. Also, as stated, the above require expensive and complicated modification to cab motors and track wires, Additionally, some of the user interfaces for the above devices are non-standardized and may be unfamiliar (unlike Microsoft Windows™ and other well-known windowed operating environments), and thus can entail a substantial learning curve in addition to the hardware modifications described above.

The present invention solves these and other problems by providing a low-cost modification to a standard electric train set, using standardized electric train equipment commonly available in department, toy, and hobby stores, in conjunction with a typical home PC. The present invention does not require any modification to engine cab motors or track wires. Also, the menu-driven interface of the present invention provides an easy-to-use interface for anyone familiar with a windowed operating environment, and is intended to be customized to conform to a user's specific layout. The present invention is not limited to electric train environments, but can also be used to control slot cars and other hobbyist devices.

SUMMARY OF THE INVENTION

It is a further object of the present invention to provide a computer/driver connection occurring through a standard PC parallel port. It is a further object of the present invention to disclose a computer/driver connection occurring through a standard PC joystick/game/MIDI port.

It is a further object of the present invention to provide a a computer/driver connection occurring through a standard PC parallel port. It is a further object of the present invention to disclose a computer/driver connection occurring through a standard PC joystick/game/MIDI port.

A still further object of the present invention is to provide software being configurable to allow a user to implement immediate setting and changing of the motor speed, direction, and track configuration using software through a windowed, menued user interface.

It is a further object of the present invention to provide a power circuit incorporating a transformer that is packaged with standard commercial train sets as a power supply, a power circuit comprising transformer and rectifier circuits for rendering standard household electricity into a form that can be used by the motor and solenoid driver circuits, and a motor driving circuit having pulse capability.

It is a further object of the present invention to provide software comprising an adjustable pulse duration for maintaining compatibility/configurability with a variety of solenoid drivers, software comprising a serial conversion algorithm for driving an 8-bit databyte through a single dataline, and software being user-configurable during installation.

It is a further object of the present invention to provide software allows the storage and retrieval of pre-set data configuration files, software which maintains a visual representation of the operating status of all motors, solenoids, and track polarities, and a power supply which protects motor drivers, solenoid drivers, and PC from transients and overvoltages.

It is a further object of the present invention to provide software storing data existing at the PC port at the time the software is initialized, and then restoring the PC port data at the time the software is exited, thereby enabling said PC port to be re-used by other processes, software permitting the user to enable and disable selected portions of said motor and solenoid layout through a user-designated selection portion in coordination with a menued user interface, and also zoom-view selected portions of the motor and solenoid layout through a user-designated selection portion in coordination with a menued user interface.

It is a further object of the present invention to provide a software permitting the user to edit either the entire motor and solenoid profile, the motor profile only, or the solenoid profile only.

It is a further object of the present invention to provide a method for controlling a plurality of model train motors and solenoids through a computer, comprising loading customized software on said computer; connecting said motors and solenoids to a port of said computer through motor, solenoid, and power interface circuits; operating said customized software to configure the PC port; thereby driving said interface circuits connected to the PC port.

Finally, it is a further object of the present invention to provide a model train motor and solenoid control apparatus, comprising a personal computer having customized software loaded therein; a motor driver means for connecting a plurality of motors to the computer; solenoid driver means for connecting a plurality of solenoids to the PC; power supplying means for delivering power to the motors; wherein the motor driver, solenoid driver, and power supplying means are responsive to the customized software for operating the motors and solenoids.

Additional objects, advantages and novel features of the invention will be set forth in the description which follows or may be learned by those skilled in the art through reading these materials or practicing the invention. The objects and advantages of the invention may be achieved through the means recited in the attached claims. To achieve these stated and other objects, the present invention may be embodied and described as the ensuing description and accompanying drawings.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Using the drawings, the preferred embodiments of the present invention will now be explained.

Figure 1:
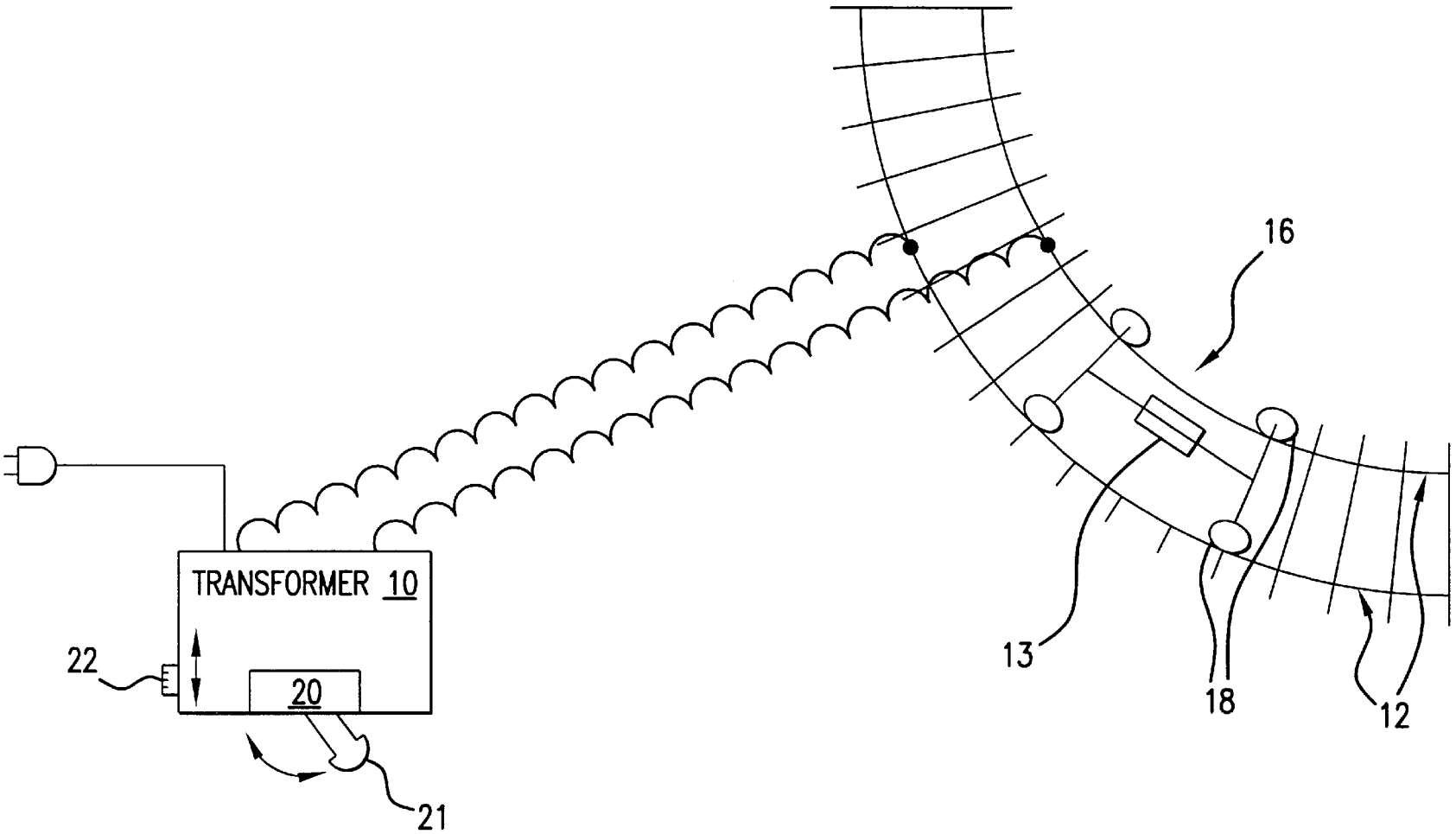
FIG. 1 PRIOR ART
FIG. 1 is a perspective view of a standard unmodified electric train layout.

FIG. 1 shows a standard, unmodified electric train layout which is to be combined with the present invention. Proportions of various devices in FIG. 1 are exaggerated or simplified for clarity. As seen in FIG. 1, electric train layouts usually consist of at least one engine (cab) 16 which can operate alone or can be pulling a series of rail cars. The motor 13inside the cab 16 obtains electricity from the transformer 10 which is connected to the rails 12, which are usually made of brass or aluminum but are also nickel plated and thus reasonably good conductors. The wheels 18 of the cab 16, also plated to be good conductors, transfer the power from rails the 12 to the motor 13 through armature windings, as is well known in the art.

A user controls the amount of power delivered to the cab 16 through the transformer 10 by manipulating a lever 21 attached to the potentiometer 20 contained within the transformer 10. A lever operates in a rotary fashion through the arc circumscribed by the double-headed arrow in FIG. 1. By manually turning lever the 21 (and thus the potentiometer 20), a user can raise or lower the power delivered to the cab 16, which affects the rate at which the motor and wheels of the cab 16 turn, and which in turn affects how fast the train moves along the track. Most the transformers 10 contain a the switch 22 to set polarity of the power delivered to the rails 12. A switch 22 can be a double-pole single-throw type, which is arranged to deliver power to the rails 12 either in a +/− or −/+ polarity. The difference in polarity controls the direction that the motor 13 turns, which then controls the direction at which the cab 16 advances along the rails 12.

Figure 2:
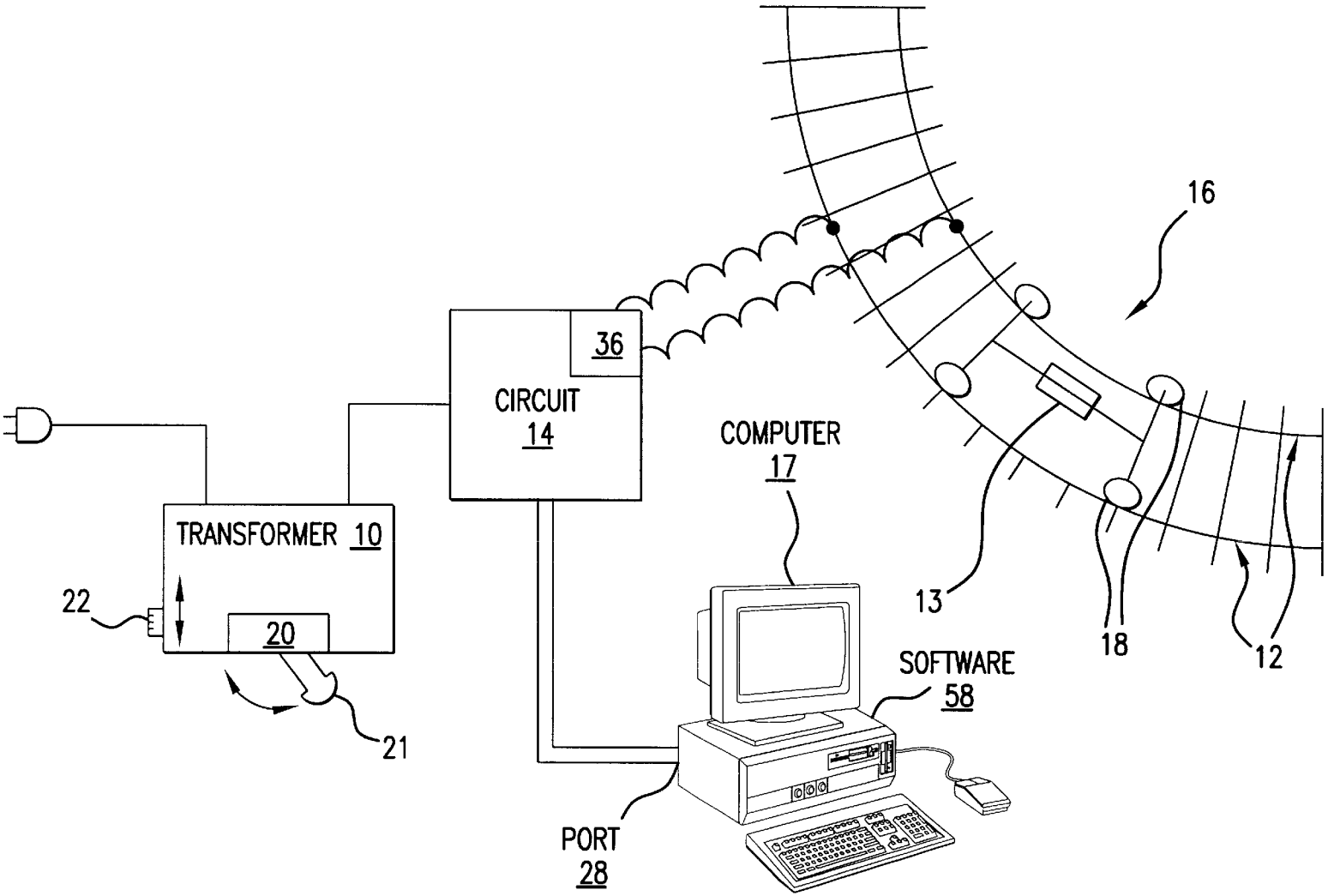
FIG. 2 is a perspective view of an electric train layout shown in FIG. 1, modified to include a single-cab embodiment of the present invention.

FIG. 2 shows a general overview of a single-cab embodiment of the present invention. Note that the transformer 10 is no longer connected to the rails 12. Instead, the transformer 10 is connected to the circuit 14, which is instead connected to the rails 12. Also, the circuit 14 is connected to the computer 17. In FIG. 2, unlike in FIG. 1, the lever 21 of the transformer 10 is rotated to its maximum capacity. This is so the transformer 10 is continually supplying its maximum capacity of power available to the stabilizer circuit 36. However, the actual amount of power delivered to the cab 16 is determined by the user not through the lever 21, but through software 58. A separate embodiment exists where power for the cab 16 is provided by a the power circuit 34, and the transformer 10 is not used at all. These power features will be discussed elsewhere in the specification.

Figure 3:
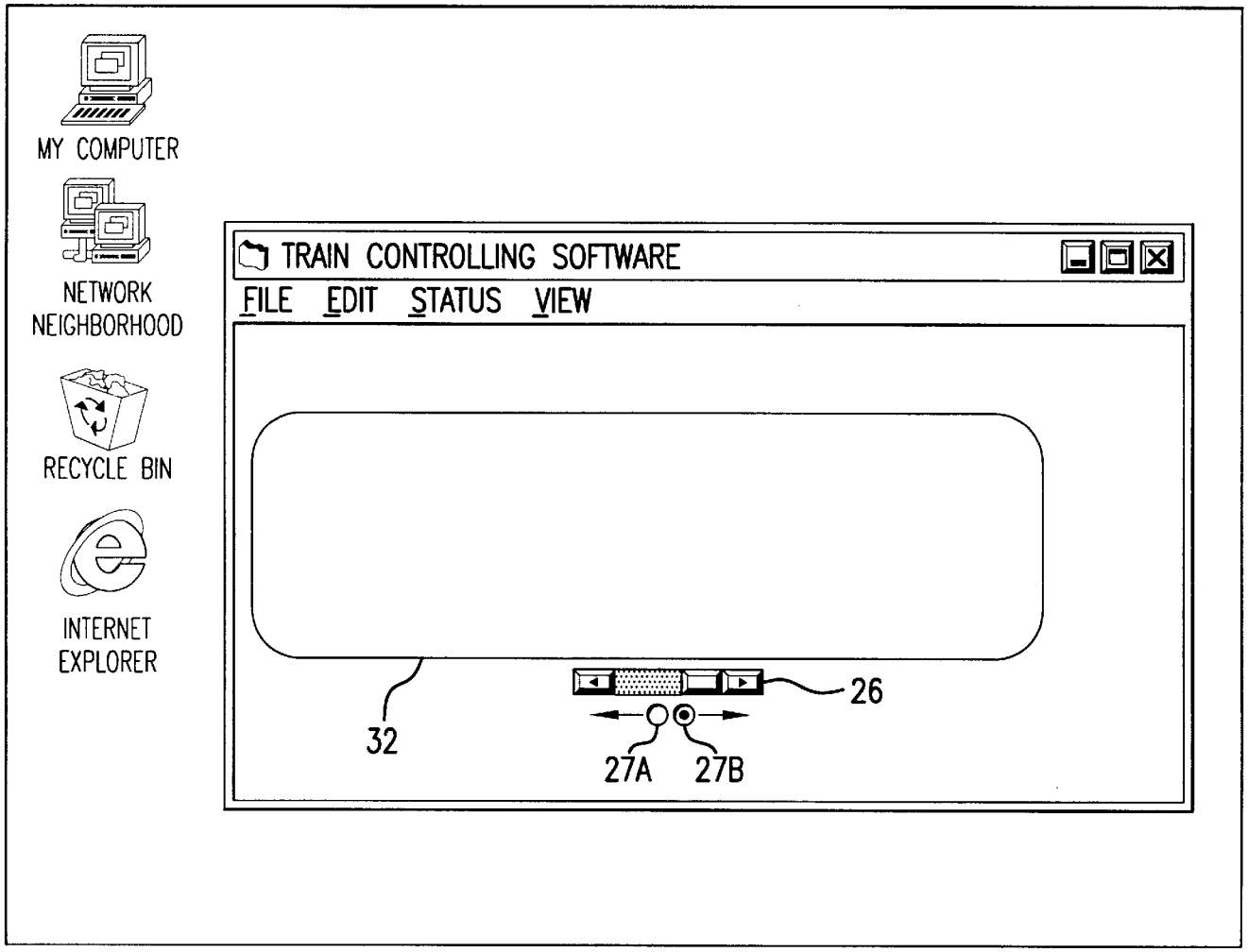
FIG. 3 is a screen capture of a computer menu configured to allow a user to control the single-cab embodiment of the present invention as shown in FIG. 2.

FIG. 3 shows an example of what would appear to the user on the screen of the computer 17 when the train layout 32 is in a typical oval shape. The slider 26 controls the amount of power delivered to the cab 16, which (as stated) controls the speed at which the cab 16 traverses the rails 12. A pair of polarity buttons 27A and 27B visually controls the direction at which the cab 16 travels across oval layout 32. The polarity buttons are in a "radio button" type of configuration, in which both buttons 27A and 27B cannot be active simultaneously. One and only one of the polarity buttons, either 27A or 27B is enabled at any one time. For example, when the user applies pressure to one polarity button 27B of a pair, the other polarity button 27A becomes disabled. Using the software 58, a user can tell a cab's direction and approximate speed just by looking at screen menus such as the one shown in FIG. 3, without having to look at the actual train layout.

The present invention's menu-driven interface provides an easy-to-use interface for anyone familiar with a windowed operating environment, and can be customized to conform to a user's specific layout. FIG. 3 shows a simple oval layout for demonstration purposes, although substantially more complicated layout patterns can be represented, as will be described elsewhere within this specification. FIG. 3 depicts the familiar Microsoft Windows™ desktop, although many other operating environments can also support the software of the present invention. Also, the simple black line in FIG. 3 could also be replaced with a substantially more detailed representation of the train layout, potentially including accessories and/or other types of landmarks. The commonly available visual compilers meant to be used with the present invention allow for a variety of image backgrounds within user menus. A browser type of arrangement could also be employed for the user interface.

PC Ports: Hardware Features

Figure 4:
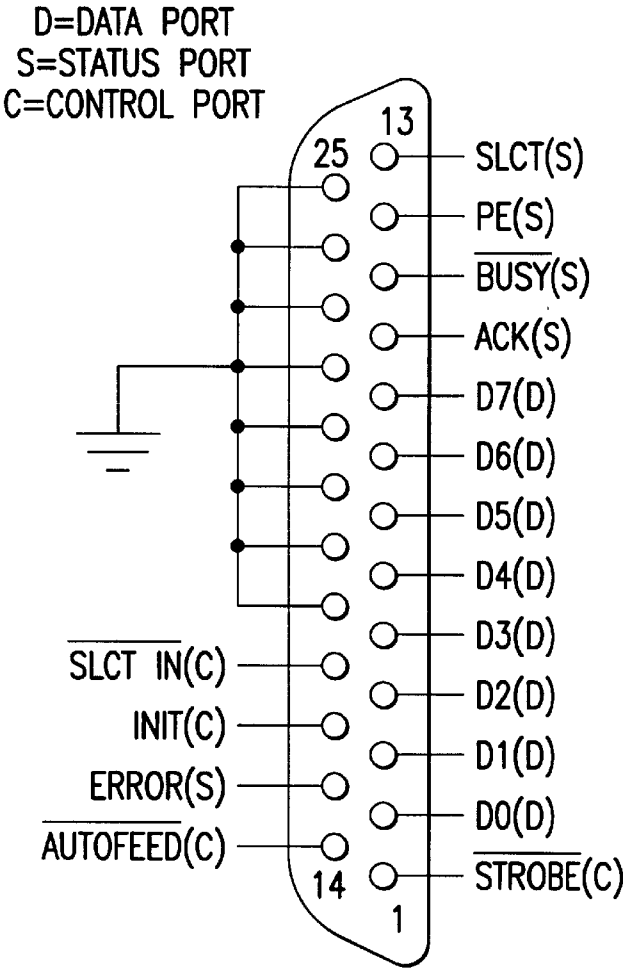
FIG. 4 is a diagram of the pin assignments of a standard PC parallel port.
Figure 4:
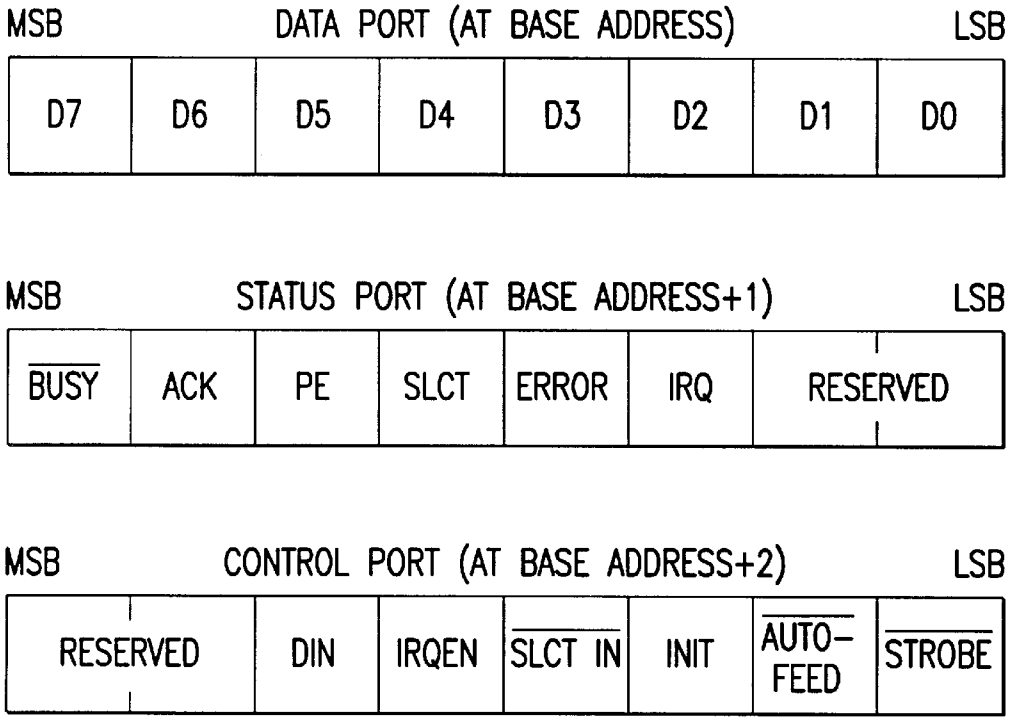

FIG. 4 shows the pin-out/wiring configuration and I/O addresses of a standard PC parallel port 28. For the single turnout and single cab embodiments described hereinafter, the only pins used are DO, AUTOFEED, STROBE, and SLCT_IN. These pin names, and several others of the data, status, and control ports and the 25-pin D-type connector pin names, were originally chosen in light of the parallel port's intended use as a printer interface. For clarity and consistency, this disclosure will continue to use the commonly accepted names. However, their actual use in the present invention will be somewhat unrelated to the commonly accepted names.

Figure 4A:
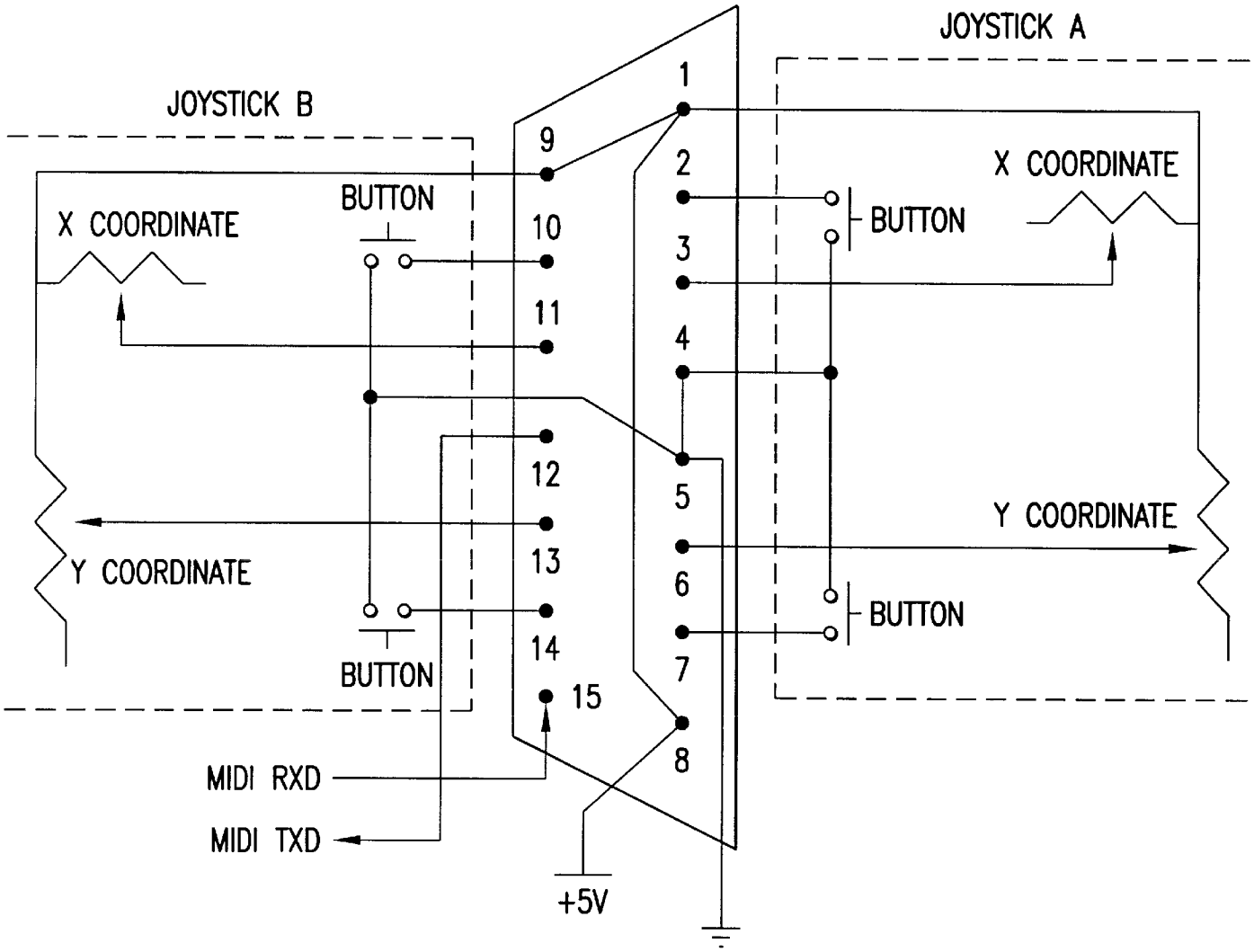
FIG. 4A is a diagram of the pin assignments of a standard PC joystick/game/MIDI port.

FIG. 4A shows the pin-out/wiring configuration and I/O addresses of a standard joystick/game/MIDI port. The PC game/music interface field is substantially less standardized than the PC parallel interface, so no one specific set of registers and pins has evolved into a de-facto industry standard. However, such a lack of standardization allows for an increased degree of user flexibility in setting up the various ports. For the purpose of this invention, 0×200 (data), 0×201 (status), and 0×202 (control) will be the joystick/game/MIDI port addresses. These addresses differ from the parallel port address 0×378 (data), 0×379 (status), and 0×37A (control). Thus, the joystick/game/MIDI ports will be operated similarly to the parallel ports except for a difference in addresses.

Finally, the present invention could also be adapted for a standard PC serial port, and could also link the computer to the circuit 14 via a bus adapter. Such a bus adapter could be either an Industry Standard Architecture (ISA) or Peripheral Component Interconnect (PCI) type, as long as such a bus adapter could be addressed by the software 58. However, the following disclosure will emphasize the standard parallel and joystick/game/MIDI ports.

Motor Control: Single Cab Embodiment

Figure 5:
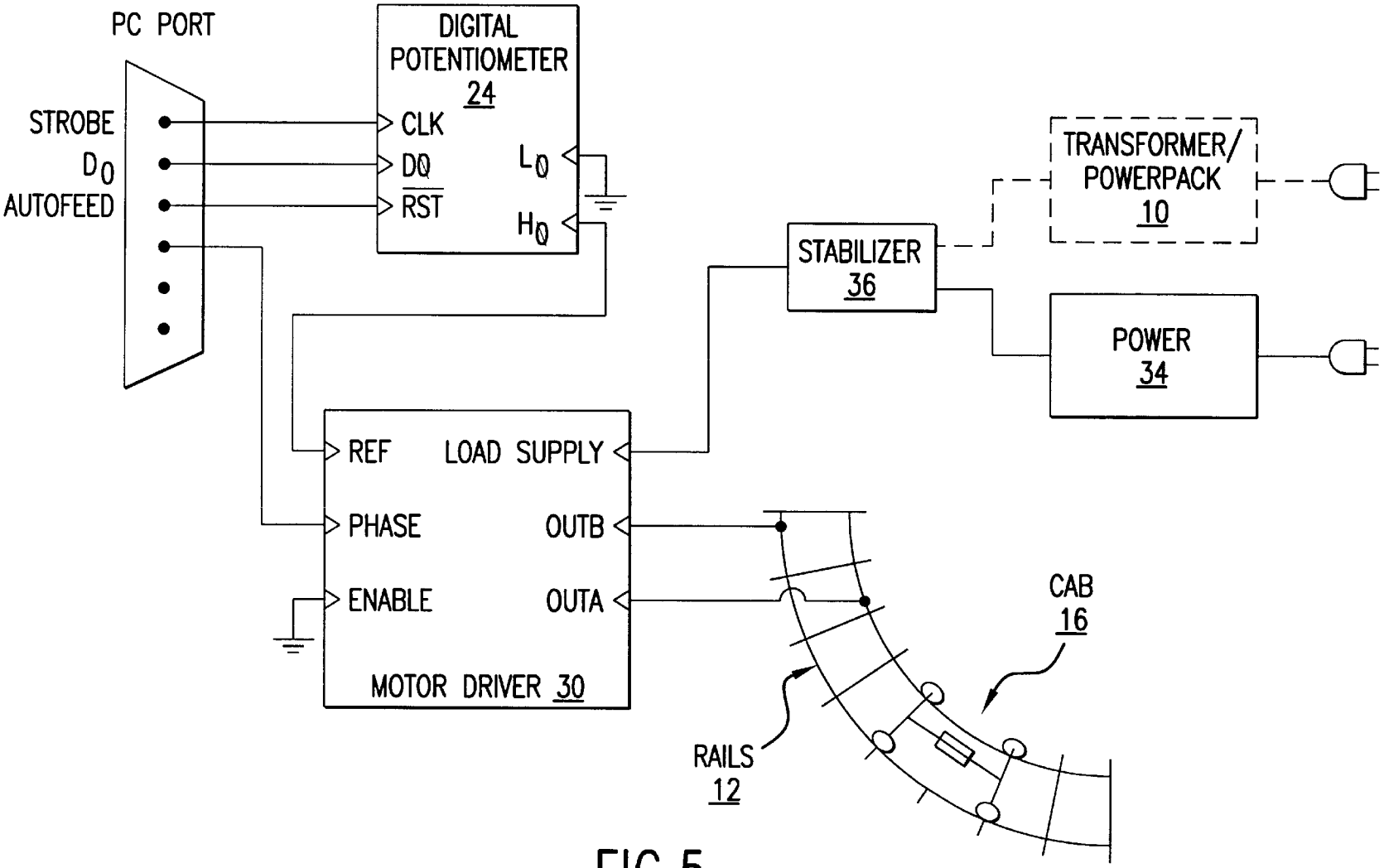
FIG. 5 is a block diagram of the cab shown in FIG. 1 connected to PC port of the present invention.

FIG. 5 shows a simplified diagram of a single-cab embodiment of the present invention using a standard PC port, where several pins are omitted for clarity. Software details showing how the PC port is operated to deliver the necessary data will be explained in more detail elsewhere within this specification. For controlling the cab 16, a digital potentiometer 24 (such as a Dallas Semiconductor Digital Potentiometer DS1867) is combined with a motor driver 30 (such as an Allegro Microsystems 3952PWM Motor Driver) to allow the computer to control the amount and polarity of power delivered to the cab 16.

The power for the cab 16 can be delivered by the power circuit 34, as shown in FIG. 5. An alternative embodiment uses the transformer/powerpack 10 that comes with most train sets, also shown in FIG. 3 but with dotted lines. In either case, the amount of power delivered to the cab 16 is selected by the user through the software 58, filtered by the stabilizer circuit 36, and then apportioned by the motor driver 30 for delivery to the rails 12.

As shown in FIG. 5, the PC port's AUTOFEED pin is connected to the digital potentiometer's RST pin. The PC port's D0 pin is connected to the digital potentiometer's DQ pin. The PC port's STROBE pin is connected to the digital potentiometer's CLK port. The PC port's INIT pin is connected to the motor driver's PHASE pin. Finally, the digital potentiometer's H0 pin is connected to the motor driver's REF pin. For clarity, several pins in both the digital potentiometer 24 and the motor driver 30 have been omitted.

The motor driver 30 uses the value delivered at the REF pin to proportion the power present at LOAD SUPPLY pin. In this way, appropriately scaled power is delivered from pins OUTB and OUTA, which are connected to the rails 12. The ENABLE pin of the motor driver 30, being active low, is always tied to ground, so that the motor driver 30 is continually delivering power to the rails 12, and is always responsive to change in the value at the H0 pin of the digital potentiometer 24, which is in turn responsive to any user-activated change in the power level through the software 58.

The digital potentiometer 24 has a granularity of 0 to 255 so that a very finely defined range of power can be delivered the cab 16. Polarity of the power delivered is controlled by the motor driver PHASE pin, thereby controlling the direction of travel of the cab 16. The PHASE pin is the only pin of motor driver 30 to be connected directly to the PC port.

Actual Operation of Single Cab Embodiment

Figure 5A:
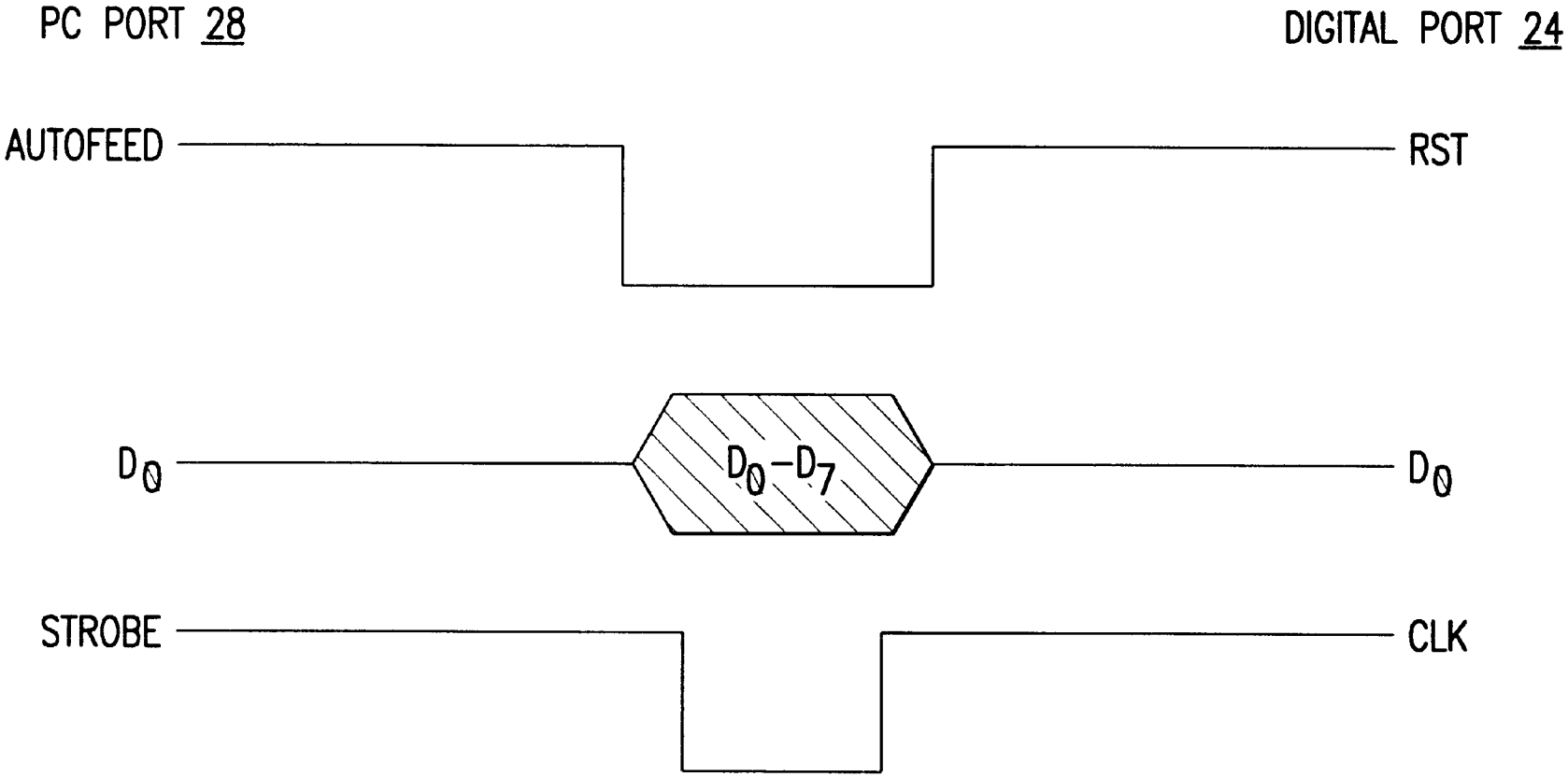
FIG. 5A is a timing diagram showing the relationship of the PC port and motor driver shown in FIG. 5.

As shown in FIG. 5A, the cab 16 is controlled as follows. First, the software 58 drives AUTOFEED low, which in turn drives the normally high digital pot pin RST to low. Then, the software 58 places serial data designating the amount of power to be delivered to the cab 16 on the PC port's D0 pin, where that data is clocked in to the digital potentiometer's DQ pin. The software 58 also drives the PC port's STROBE pin to synchronize the clocking of data into digital potentiometer, where the STROBE pin is connected to the digital pot's CLK pin. The parallel to serial conversion or "bit banging" necessary to synch the clocking of 8 bits through one datapin (D0) is detailed below. After the data has been received and stored by the digital potentiometer 24, the AUTOFEED pin is returned to high, thereby returning RST to high. The digital potentiometer 24 then holds that data value until RST (AUTOFEED) is driven low again.

The following code fragment demonstrates how the software 58 operates the PC port 28 in order to drive a cab motor.

```
int  DATAPORT = 0x378,                      /* for this example, use LPT1 port */
     STATUSPORT = DATAPORT + 1,
     CONTROLPORT = DATAPORT + 2,
     user_input,                            /* data byte inputted by user for cab speed */
     bitcount,
     shiftcopy;                             /* create a register convenient for shifting */
     outportb(CONTROLPORT, 0xFD)            /* drive AUTOFEED-RST low,
                                            leave everything else high */
     for (bitcount = 0; bitcount < 8; bitcount++)
     {
          shiftcopy = user_input<<bitcount; /* shift value left to check bits
                                            shift 0 places for D7, 1 place for D6,
                                            2 places for D5, etc . . . */
          if ((shiftcopy & 0x80) > 0)       /* MSB 1 or 0? */
          {                                 /* MSB = 1 */
               outportb(DATAPORT, 0x01);    /* drive D0 high (because MSB = 1) */
               outportb(CONTROLPORT, 0xFC)  /* drive STROBE-CLK low,
                                            m/while keep AUTOFEED-RST low */
          }
          else
          {                                 /* MSB = 0 */
               outportb(DATAPORT, 0x00);    /* drive D0 low (because MSB = 0) */
               outportb(CONTROLPORT, 0xFC)  /* drive STROBE-CLK low,
                                            m/while keep AUTOFEED-RST low */
          }
     }                                      /* repeat for all 8 bits of user_input */
     outportb(CONTROLPORT, 0xFF)            /* return AUTOFEED-RST to high */
```

Figure 5B:
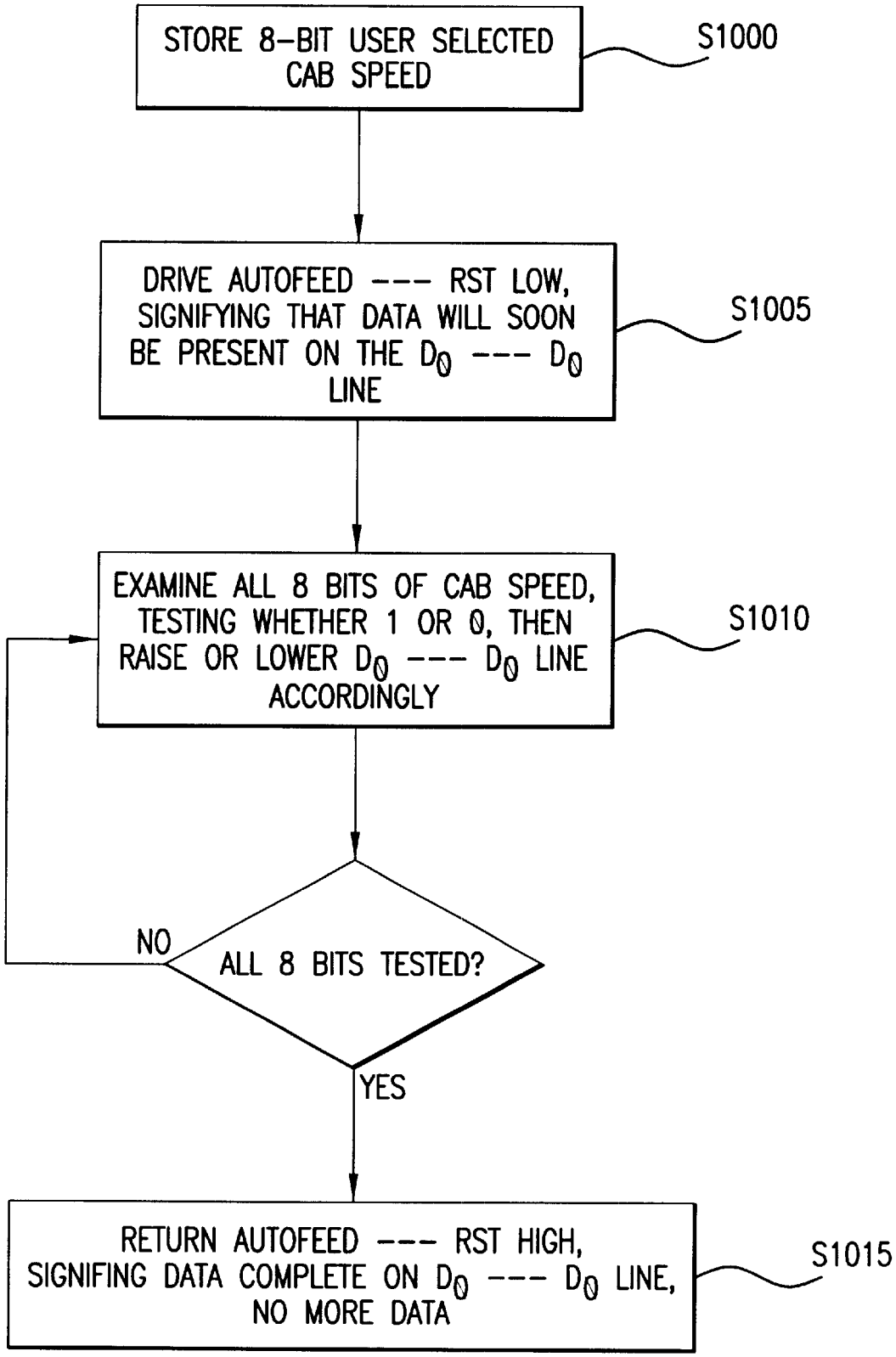
FIG. 5B is a flow chart describing how the software drives the PC port shown in FIG. 5.

FIG. 5B shows a flowchart providing a broader, less computer language-specific description of software that can operate the motor driver 30. The software steps that must be accomplished, regardless of language to drive the PC port include storing the 8-bit cab speed value selected by the user (S1000). Then, drive the AUTOFEED- -RST line low, which signifies that data will soon be present on the D0- -DQ line (S1005). Afterwards, raise or lower the D0- -DQ for each bit of the 8-bit user selected speed value (S1010). Finally, return the AUTOFEED- -RST line high, signifying that no more data will be present on the D0- -DQ line (S1015).

Power Considerations

As stated, power need not be supplied from the transformer 10. A power circuit 34 can perform the same purpose as the transformer 10 which was originally packaged with the model train. However, both embodiments make use of a power stabilizer 36. The stabilizer 36 filters and stabilizes the power delivered, as well as protects the motor driver 30 from transients and overvoltages. As shown in FIG. 5, either power circuit or transformer can be connected to the power stabilizer 36.

Figure 6:
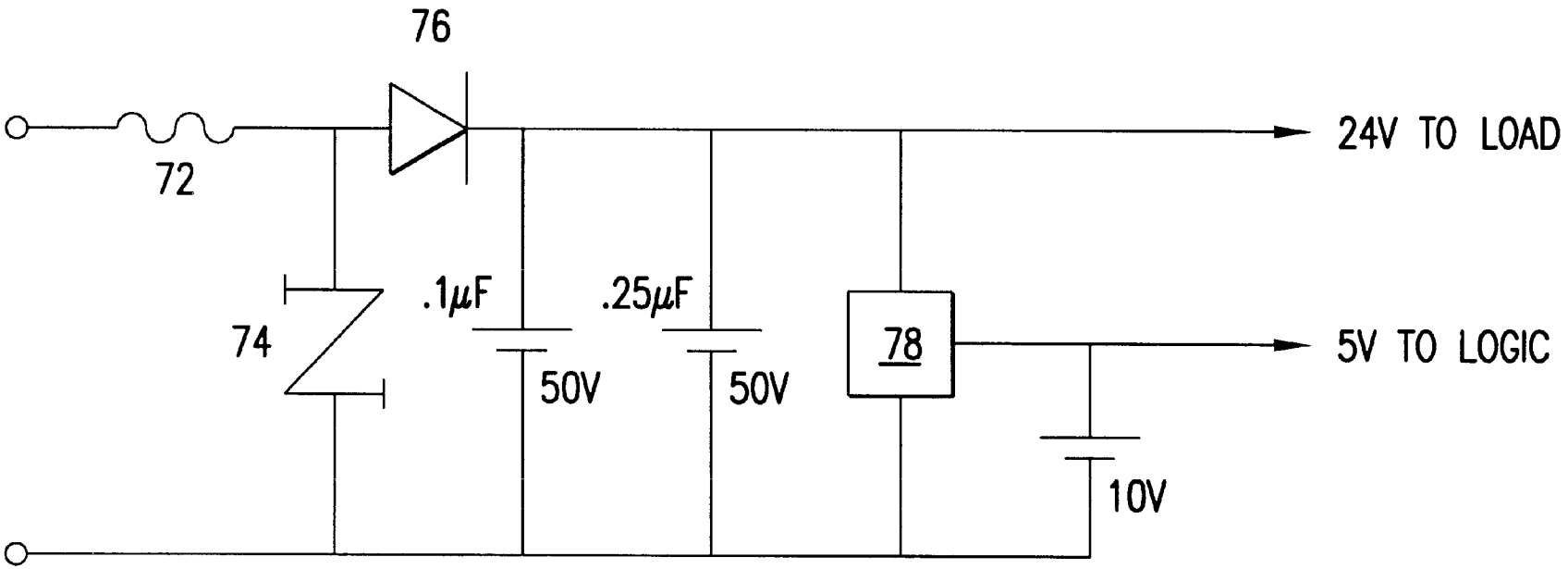
FIG. 6 is a schematic diagram of the stabilizer circuit shown in FIG. 5.

FIG. 6 is a schematic diagram of stabilizer circuit 36. DC power is delivered to the stabilizer terminals 70, either from the power circuit 34 or the transformer 10. After traversing the stabilizer circuit 36, 24V of stable, reliable DC power is then delivered to the LOAD SUPPLY pin of the motor driver, and 5V is available to drive the logic supplies of the various Integrated Circuits (ICs) contained within the invention. A 4 amp fast-blow fuse 72 exists to protect the invention from overvoltage, as well as a transient suppressor 74. The transient suppressor 74 can be a 30 Volt zener diode. A diode 76 exists to protect the invention from connecting the input power in the wrong polarity. A 24/5 Voltage Regulating Integrated Circuit 78 exists to divide voltage either to 24 or 5 Volts.

Figure 7:
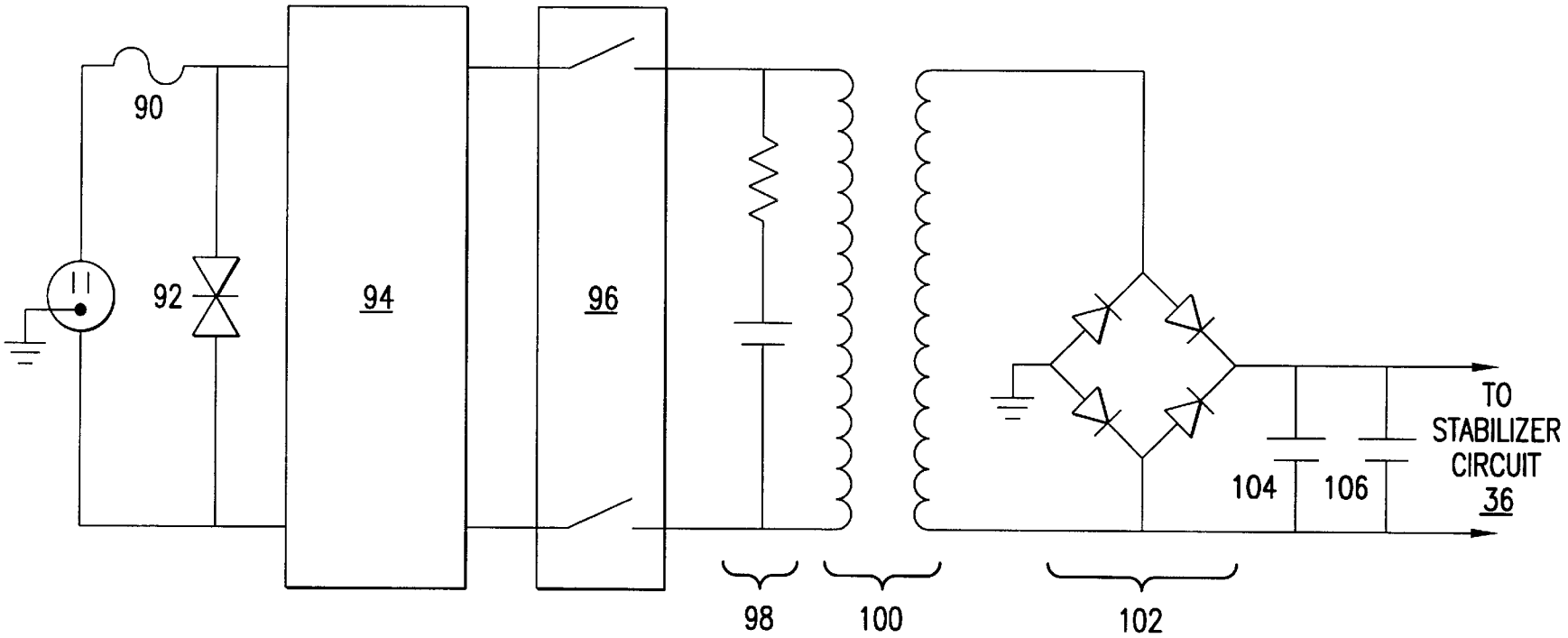
FIG. 7 is a schematic diagram of the power circuit shown in FIG. 5.

FIG. 7 is a schematic diagram of the power circuit 34, which is used in the embodiment where transformer 10 is not used. As shown in FIG. 3B, power is obtained from a wall outlet and delivered across a slow-blow AC fuse 90. Power is then delivered across a transient suppressor 92, which protects the circuit from a lightning strike, and a line filter 94, which filters out high-frequency noise. Power is then delivered across a switch 96, which is operated by the user, and a spark suppression circuit 98. A stepdown transformer 100 then lowers the voltage present at the circuit 98 from 120V to 24V, while a full-wave bridge rectifier 102 transforms the voltage present at transformer 100 from AC to DC. Finally, a filter capacitor 104 removes high frequencies while a filter capacitor 106 removes AC ripple. When power arrives to this end of the circuit, it is appropriately filtered and ready for delivery to the stabilizer circuit 36.

An additional power consideration is that the digital potentiometer 24 can provide a pulsed form of power, which is advantageous for enabling smoother operation of the cab 16. This is because the wheels of the cab 16, at low power levels, have a tendency to fail to draw sufficient power from the rails 12 to continue turning the motor 13. How effectively the motor 13 inside the cab 16 responds to the changes in speed provided by the user depends on weight of the cab 16, contact between the cab wheels and the rails 12, level of oxidization of the rails 12, and other factors that are difficult for a user to control. Operating the cab motor 13 using a pulsed power provides overcomes some of these problems and provides smoother stopping and starting and more realistic trainlike operation, particularly at low speeds.

Turnout Solenoid Control: Single Turnout Embodiment

Figure 8B:
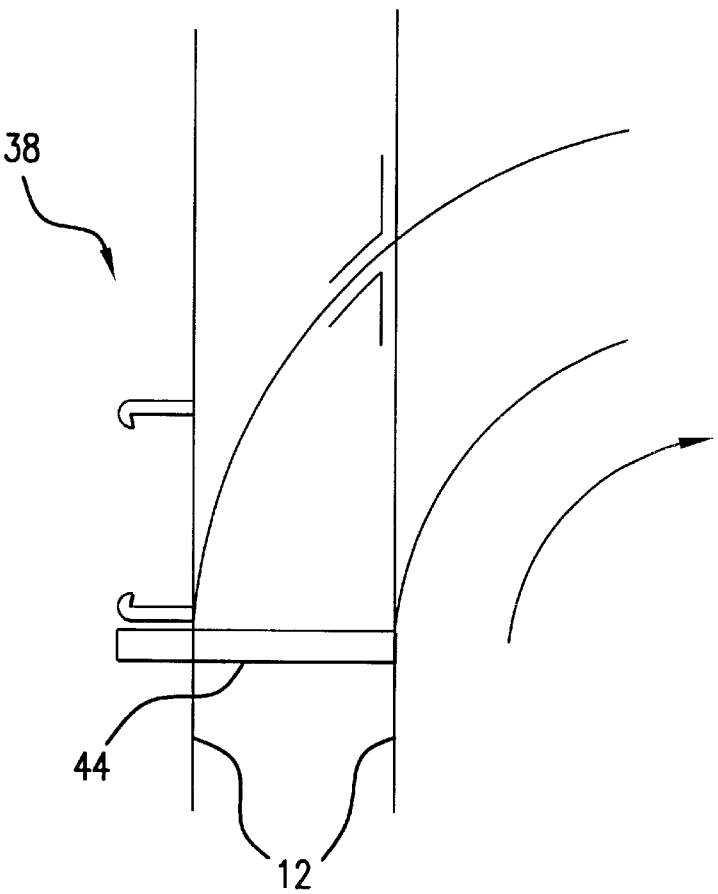
FIG.8B PRIOR ART
FIG. 8B is a plan view of a conventional Left Hand turnout pointed 'right'.
Figure 8A:
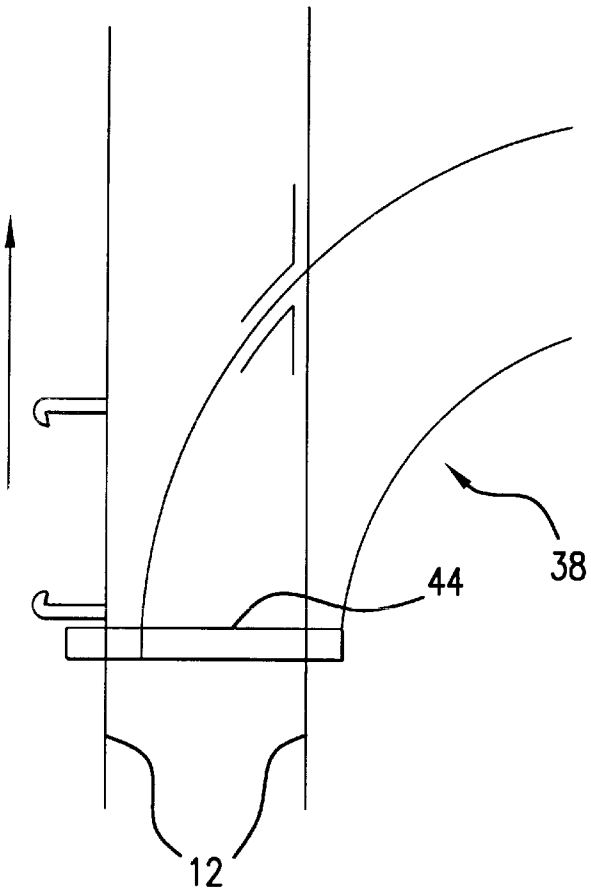
FIG.8A PRIOR ART
FIG. 8A is a plan view of a conventional Left Hand turnout pointed 'straight'.

It is well known within model trains layouts to employ turnouts (switches) which can be either hand-operated or powered by motors which are activated remotely. A left-hand turnout 38 is shown in FIGS. 8A (straight position) and 4B (right position). The proportions of the turnout in FIGS. 8A and 8B are exaggerated so as to more effectively illustrate the relationship between the turnout and the position of the rails 12. The arrows in FIGS. 8A and 8B show the intended direction of travel of the cab 16. The user's choice of direction is set by moving the shift arm 44 in a horizontal direction. As stated, FIGS. 8A and 8B showed a turnout 38, but without a solenoid motor 42 for remote control, which would normally be contained inside the grippers 43. This is because the purpose of FIGS. 8A and 8B is to show how the movement of the shift arm 44 affects the direction of travel of the cab 16 across the turnout 38.

All three rail portions of the turnout 38 (straight, right, and center) are at the same electrical potential with respect to the power stabilizer 36. These turnouts 38 can be operated via remote control using a solenoid motor 42. In the conventional model train layout, the solenoid motor 42 is attached to a user-operated electrical switch. However, in the present invention, the solenoid motor 42 is connected to a solenoid driver 52 operated by the software 58.

Figure 9:
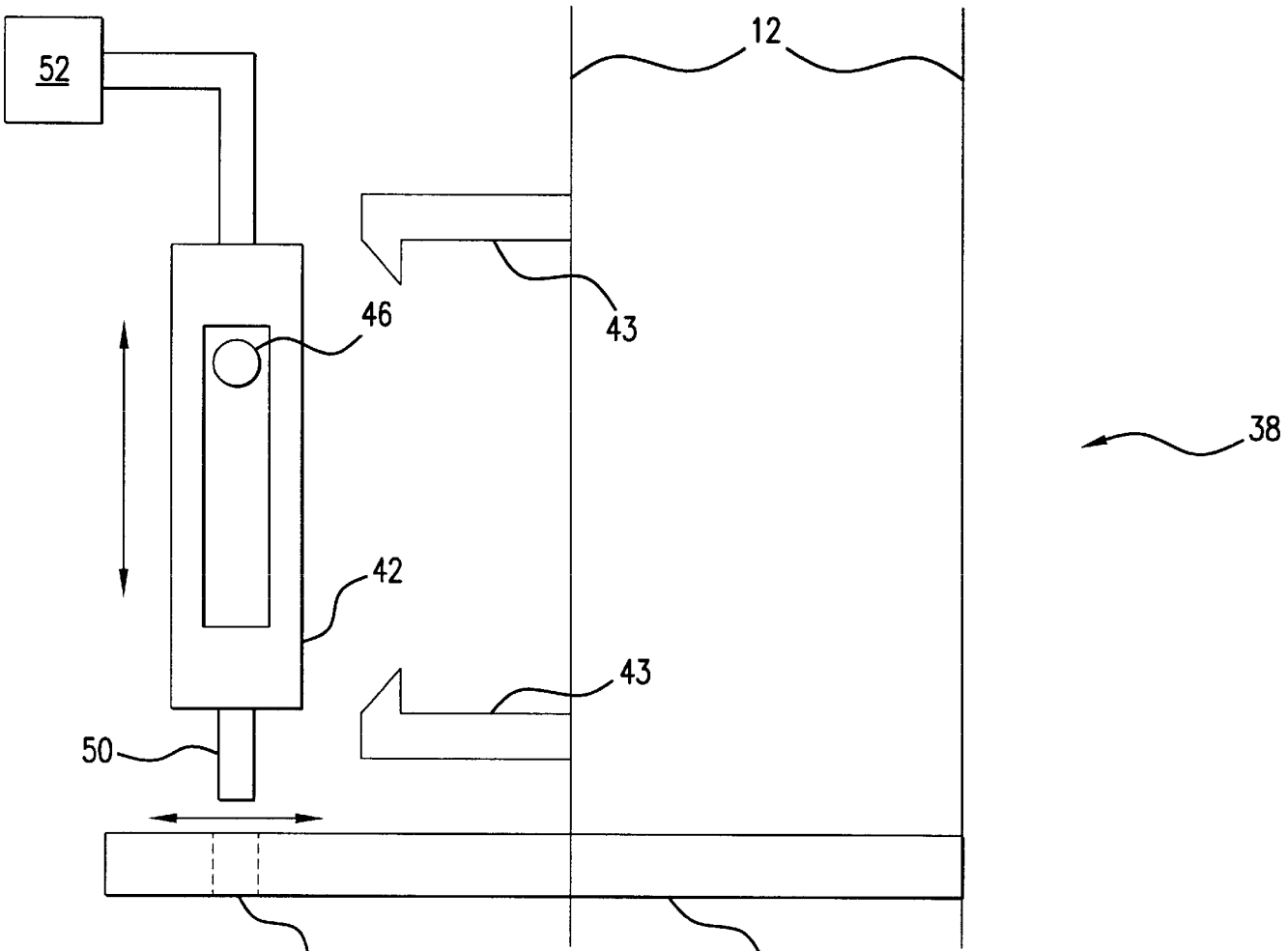
FIG. 9 is a plan view of a solenoid motor installed within a turnout connected to the present invention.

FIG. 9 shows a solenoid motor 42 and its relationship with the turnout 38. For clarity, the solenoid motor 42 is shown outside of the grippers 43. Under normal operating conditions, the grippers 43 act to secure the solenoid motor 42 to the turnout 38. As shown in FIG. 5, the lever 46 protrudes from the top of the solenoid motor 42 in a way that is easily graspable by a users fingers. The stub 50 also protrudes from the switch machine 42, but protrudes laterally rather than from the top of the switch machine 40. The stub 50 is moved by the solenoid motor 42, and is attached to the shift arm 44 at the aperture 45.

Solenoid motors 42 such as that shown in FIG. 9 are widely available, well known in the art, and usually manufactured by the same companies that manufacture the turnouts 38. One example of a switch machine and solenoid motor is the Left Remote Switch, part # 52, manufactured by Atlas Train Co. (www.atlasrr.com). A similar, equally compatible product is manufactured by Micro Trains (www.micro-trains.com). A solenoid driver 52 (such as a Texas Instruments TPIC6B595 shift register and solenoid driver) can control multiple solenoid motors 42 connected to various turnouts 38. One solenoid driver 52 can drive as many as four solenoid motors 42, because two solenoid driver 52 ports are used for each solenoid motor 42. One drain port drives the motor 42 forward, and one drain port drives the motor 42 in reverse. Should it be necessary that more than four turnout solenoids be controlled, several solenoid drivers 52 can be cascaded through use of the SER OUT pin, or controlled by a multiplexed arrangement as discussed infra in the "Multiple Cab/Solenoid Controls: multiplexed output" section of this specification.

Figure 10:
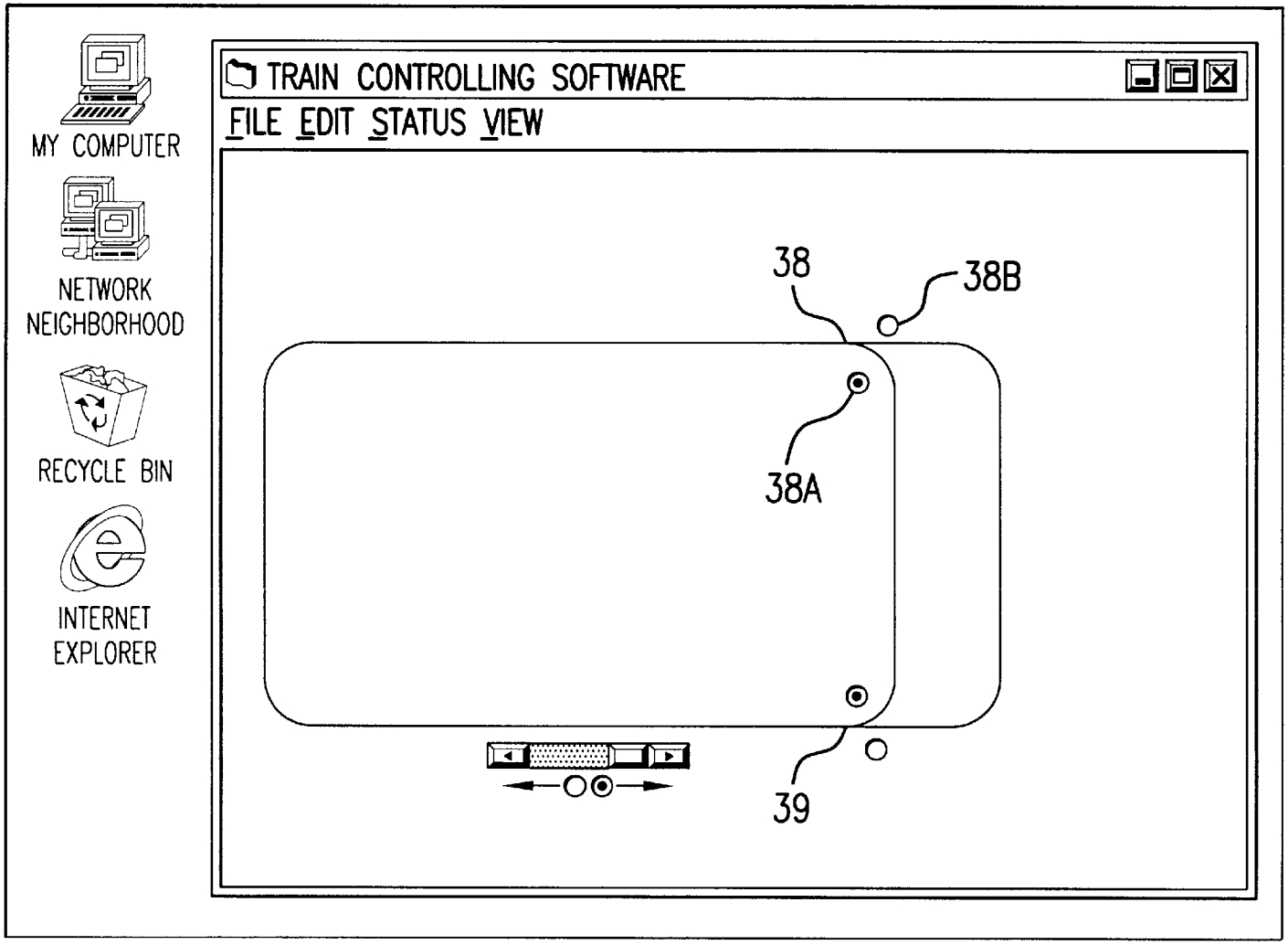
FIG. 10 is a screen capture of a computer menu configured to allow a user to control the solenoid driver shown in FIG. 9.

FIG. 10 shows an example of what would appear to the user on the screen of PC 17 when the train layout is in a typical double-oval shape, with two turnouts 38 and 39. As stated, the slider 26 controls the amount of power delivered to the cab 16. However, a pair of polarity buttons 38A and 38B visually control the direction of travel of the turnout 38. The polarity buttons are in a "radio button" type of configuration, in which both buttons 38A and 38B cannot be active simultaneously. One and only one polarity button is enabled at any one time. For example, when the user applies pressure to the one polarity button 38B of a pair, the other polarity button 38A becomes disabled. As shown, the present invention's menu-driven interface provides an easy-to-use interface for anyone familiar with a windowed operating environment, and can be customized to conform to a user's specific layout. FIG. 10 shows a simple double-oval layout for illustration purposes, although substantially more complicated layout patterns can be represented, as will be described elsewhere within this specification.

FIG. 10, like FIG. 3, also shows the Microsoft Windows™ desktop, although many other operating environments can also support the software of the present invention. Again, as stated, the simple black line in FIGS. 3 and 10 could also be replaced with a substantially more detailed representation of the train layout, potentially including accessories and/or other types of landmarks. The commonly available visual compilers meant to be used with the present invention allow for a variety of image backgrounds within user menus. A browser type of arrangement could also be employed for the user interface.

Figure 11:
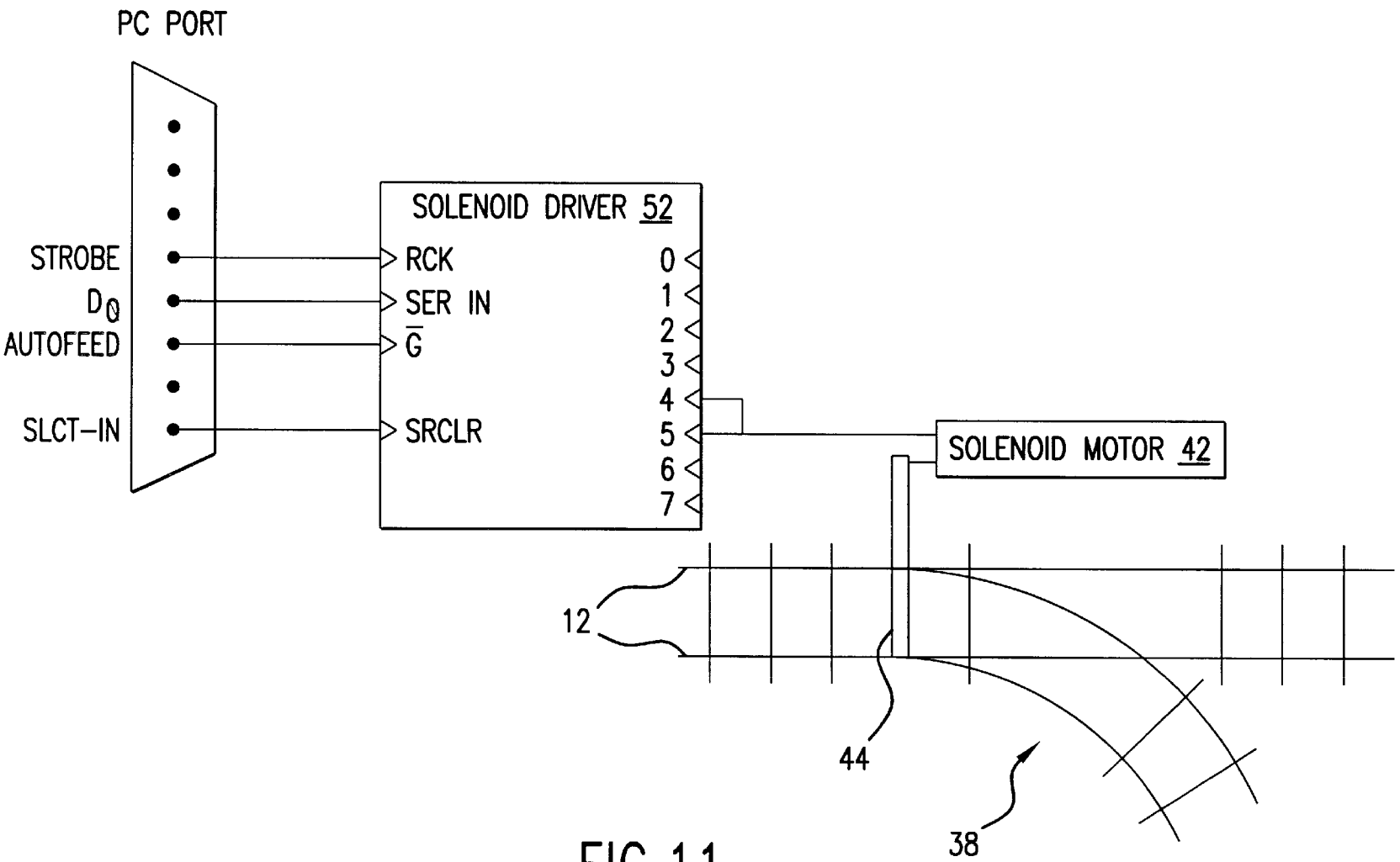
FIG. 11 is a plan view of a PC port connected to the solenoid driver shown in FIG. 9.

FIG. 11 shows a solenoid motor 42 connected to a PC port 28 through the solenoid driver 52, with several pins not shown to enhance clarity. In FIG. 11, a PC parallel port is shown, although, as stated, the present invention can be operated through a typical PC game/MIDI/joystick port or serial port also. As shown, the PC port's AUTOFEED pin is connected to the solenoid driver's G pin. The PC port's D0 pin is connected to the solenoid driver's SER IN pin. The PC port's STROBE pin is connected to the solenoid drivers RCK pin. Finally, the PC port's SLCT_IN pin is connected to the solenoid driver's SRCLR pin.

Figure 11A:
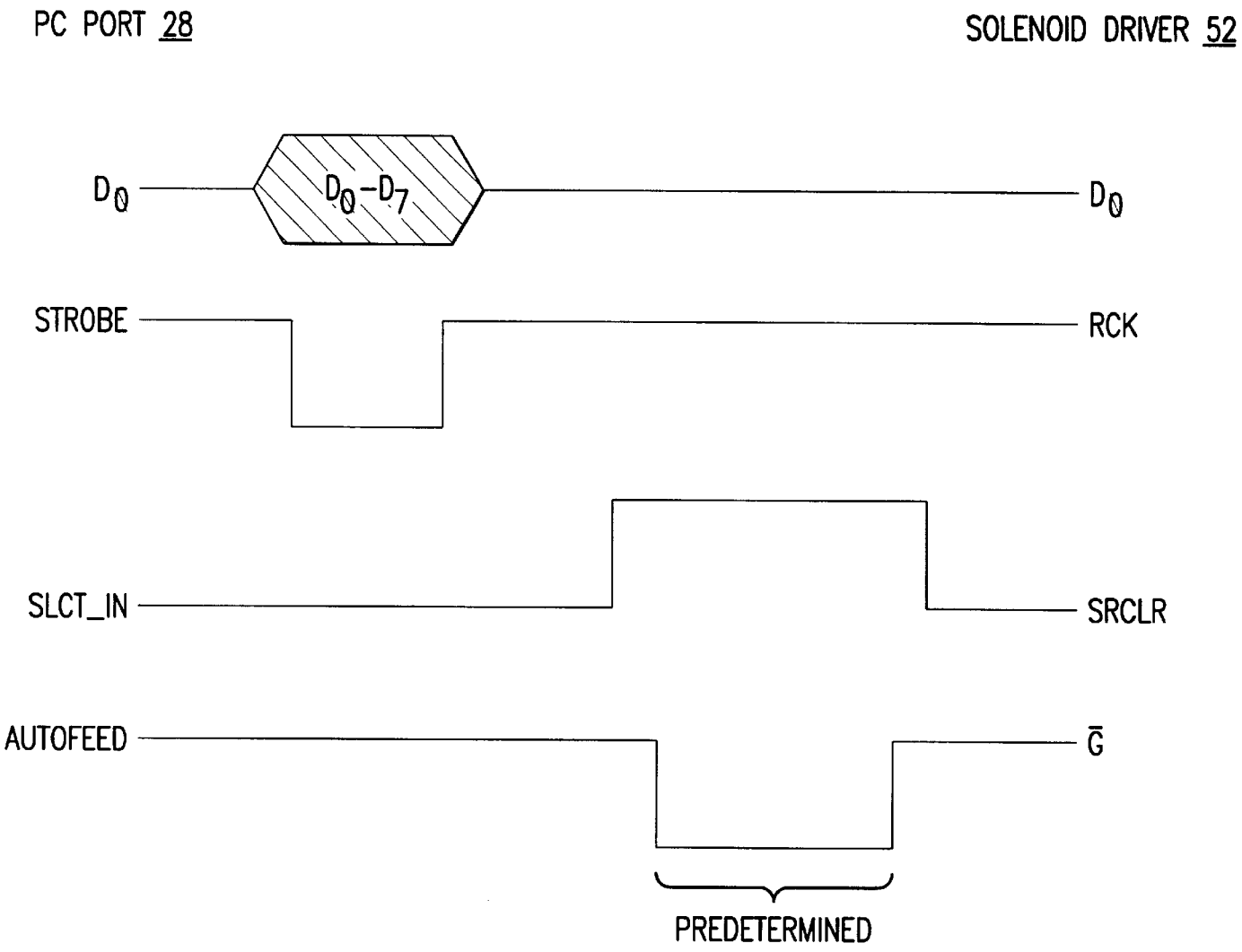
FIG. 11A is a timing diagram showing the relationship of the PC port and solenoid driver, as shown in FIG. 11.

As shown in FIG. 11A, the turnout solenoid 42 is controlled as follows. First, a byte of data designating which "drain" port of the solenoid driver is to be driven is delivered by the software 58 on the PC port D0 pin, which as stated is connected to the solenoid driver's SER IN pin. The necessary clock synchronization is delivered from the STROBE pin to the RCK pin. SLCT_IN is then brought high resulting in bringing SRCLR high, thereby causing the data byte to be stored in the D-type storage register associated with a particular solenoid motor 42. Then, AUTOFEED is brought low, in turn bringing the solenoid driver's pin G low. At the point that pin G is brought low, the drain port designated by the serial data then supplies current to the solenoid motor 42 connected thereto, either driving or returning the solenoid motor 42 into the desired position. In FIG. 11, the solenoid motor 42 is shown as being connected to the solenoid driver's drain ports 4 and 5 for demonstration purposes only, and any of the solenoid driver's 8 drain ports could be used. Two solenoid driver 52 ports are used for each solenoid motor 42. One to drive the motor 42 forward, and one to drive the motor 42 in reverse.

```
void user_duration(int);          /* function prototype, no return code necessary */
int     DATAPORT = 0x378,                          /* for this example, use LPT1 port */
        STATUSPORT = DATAPORT + 1,
        CONTROLPORT = DATAPORT + 2,
        user_input,                                /* data byte designating turnout selected by user */
        bitcount,
        solenoid_choice,                           /* user's choice for length of time to pulse the solenoid */
        shiftcopy;                                 /* create a register convenient for shifting */
        for (bitcount = 0; bitcount < 8; bitcount++)
        {
            shiftcopy = user_input<<bitcount;      /* shift value left to check bits
                                                      shift 0 places for D7, 1 place for D6,
                                                      2 places for D5, etc . . . */
            if ((shiftcopy & 0x80) > 0)            /* MSB 1 or 0? */
```

-continued

```
        {                                   /* MSB = 1 */
            outportb(DATAPORT, 0x01);       /* drive D0 high (because MSB = 1) */
            outportb(CONTROLPORT, 0xFE)     /* drive STROBE-RCK low */
        }
        else
        {                                   /* MSB = 0 */
            outportb(DATAPORT, 0x00);       /* drive D0 low (because MSB = 0) */
            outportb(CONTROLPORT, 0xFE)     /* drive STROBE-RCK low */
        }
    }                                       /* repeat for all 8 bits of user_input */
    outportb(CONTROLPORT, 0xFF)             /* set SLCT_IN-SRCLR high, thereby moving
                                               clocked data into D-type storage,
                                               keep STROBE high signifying no more data */
    outportb(CONTROLPORT, 0xFD)             /* set AUTOFEED-G low, thereby enabling
                                               supplying of current to selected solenoid
                                               (m/while keeping SLCT_IN-SRCLR high) */
    user_duration(solenoid_choice);         /* hold AUTOFEED-G low for user-selected duration
                                               by calling the function user_duration( )*/
    outportb(CONTROLPORT, 0xFF)             /* restore AUTOFEED-G high, thereby shutting off
                                               current supply, also clears all data in D-type storage */
    outportb(CONTROLPORT, 0xF7)             /* set SLCT_IN-SRCLR low, thereby clearing
                                               input shift register */
```

Figure 11B:
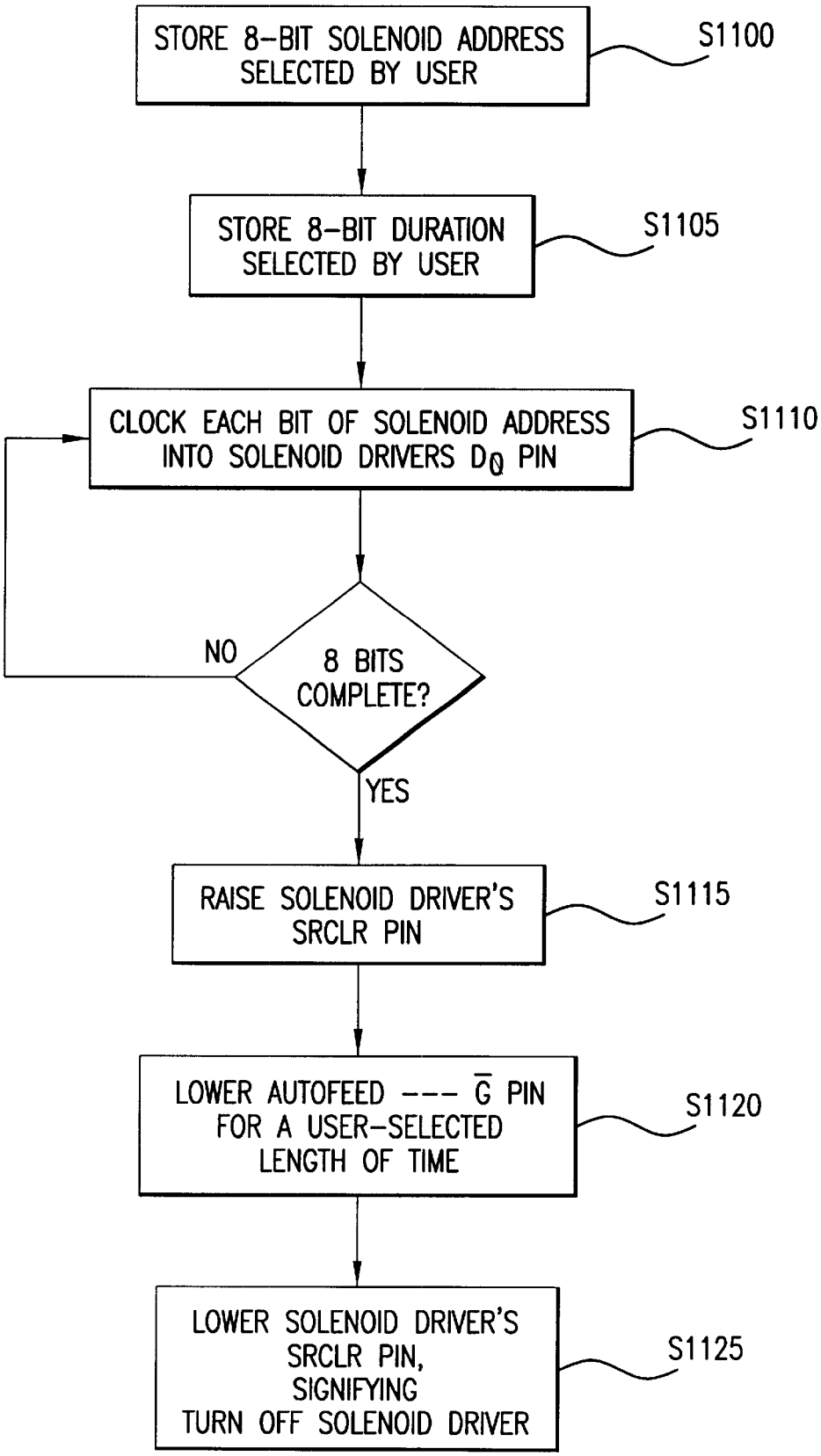
FIG. 11B is a flow chart describing the function of the software configuration of the PC port as shown in FIG. 11.

FIG. 11B shows a flowchart providing a broader, less computer language-specific description of the software 58 which can operate the solenoid driver 52. The software steps that must be accomplished, regardless of language, to drive the PC port include storing the 8-bit solenoid address selected by the user (S1100). Then, store the solenoid duration selected by the user (S1105). Afterwards, drive the D0- -DQ line either low or high depending on each bit of the 8-bit solenoid address (S1110). Once an address has been established, raise the SRLCR pin of the particular solenoid driver addressed by the user (S1115). Then, to actually activate the solenoid driver 52, lower the AUTOFEED- -G line for the length of time chosen as appropriate by the user (S1120). Finally, lower the selected solenoid driver's SRCLR pin (S1125).

A well known problem with the solenoids 42 generally available is that they burn out and need to be replaced often. Such damage can be due to power being applied to the solenoid 42 for an excessively long period of time. A burst of 0.25 seconds in duration is usually sufficient to trigger the solenoid 42 sufficiently to move the shift arm 44. A well known problem is for users to press and hold a switch substantially longer than 0.25 seconds, sometimes causing the solenoid 42 to bum out or melt.

For this reason, the software 58 can be configured by the user to provide the solenoid driver with an adjustable duration, in order to properly drive the solenoid motor 42, but not overload it. Also, many different solenoids are available which can accomplish the function of the solenoid motor 42. A user-adjustable duration can assist in maintaining compatibility/configurability with a variety of solenoids and solenoid drivers.

The following code fragment demonstrates how the software 58 queries the system clock to manage the user-specified length of time to drive a solenoid motor 42.

```
#include <time.h>                          /* necessary for querying system clock */
void user_duration([void] int);            /* function prototype, no parameters or return code necessary */
user_duration(users_choice)
{
long    begin,                             /* baseline marker, signifies beginning of time period where solenoid energized */
        users_choice,                      /* duration of time for energizing solenoid, selected by user or default */
        currently_activated;               /* length of time solenoid has been energized */
        begin = clock( );                  /* set up baseline */
        currently_activated = clock( );    /* begin tolling time in same statement */
        while (users_choice[_duration] <= currently_activated - begin)
        {                                      /* stay in routine until user-selected time elapses */
            currently_activated = clock( );    /* what time is it? */
        }                                      /* time elapsed, exit routine */
}
```

Basically, the software 58 activates the solenoid and stores the time at which it was activated (begins). The 'while' loop then polls the system clock, repeatedly asking "what time is it?", each time updating the currently_ activated variable. The clock( ) function returns a time in a granularity of microseconds. The while loop repeatedly tests the length of time activated (currently_ activated — begin) against the time specified by the user. When the length of time the solenoid 42 has been energized exceeds the time designated by the user, the software exits the 'while' loop and then raises pin G back to its high status.

Additional Software Characteristics

The software routines described above for managing the ports can be precompiled into classes, which can then be called from end-user classes exercising inheritance. Such an arrangement enables a programmer to concern herself with developing high-level applications using the precompiled classes, while being shielded from having to learn and then code the specific characteristics of each port and the devices connected thereto. Such classes are possible because both PC ports are mapped similarly across most PC platforms. Coding directly to the PC ports is substantially less complex than requesting use of the port from the operating system, the methods of which may vary substantially from one operating system, such as Microsoft Windows NT™, to another, such as Unix. However, requesting use of the port from the operating system also has advantages, such as scheduling and resolving a contentions where more than one application wishes to use the requested port.

Figure 14:
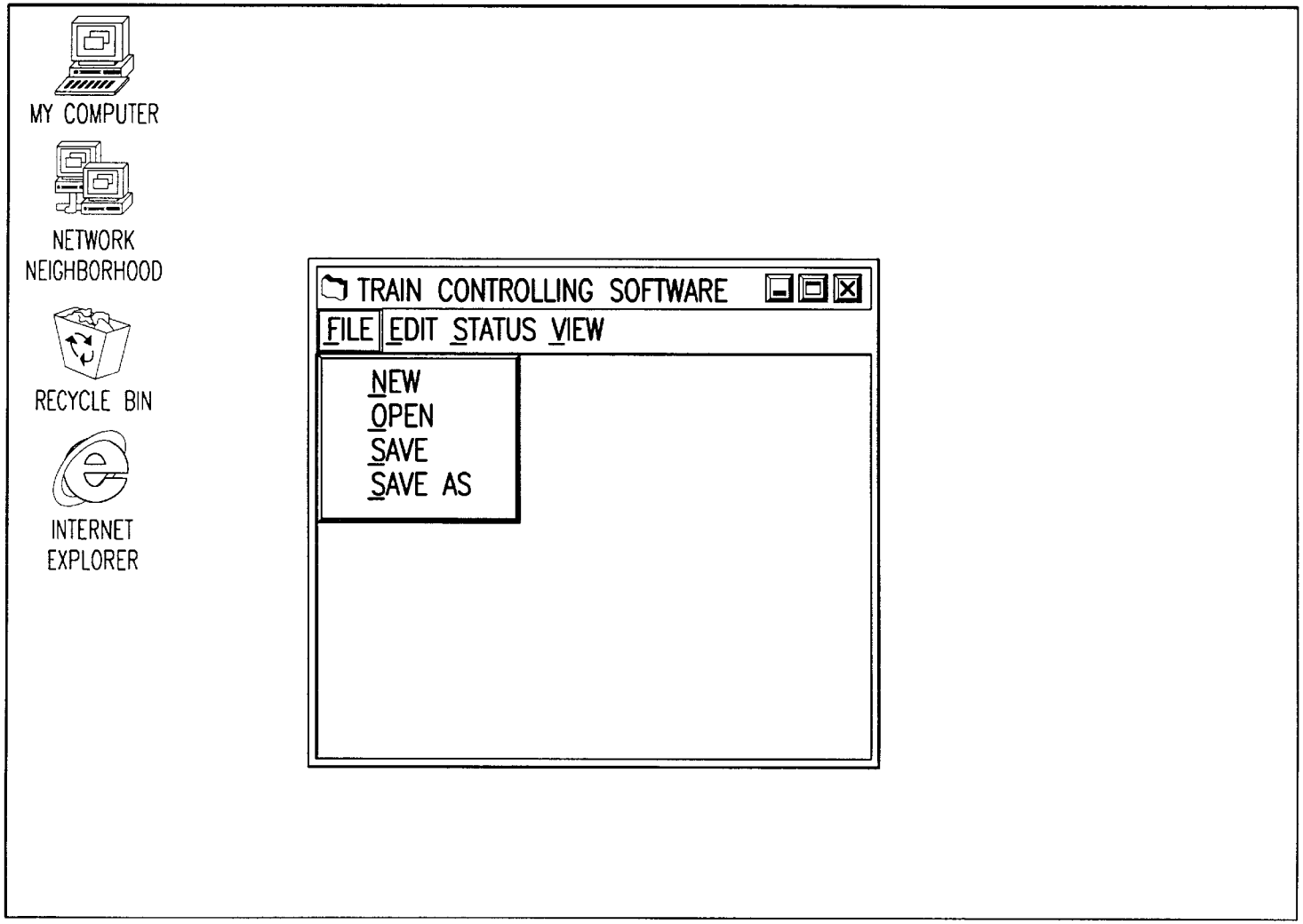
FIG. 14 shows a screen capture of a computer menu of the present invention displaying how the software has the ability to open and save user profiles.

It is also worthwhile to note that the software 58 can store a profile copy of the contents of data, status, and control ports as they exist at the time the software 58 is first loaded. This is so that a user restore the contents of these ports in the event it is desired to exit the software 58 and return the use of the port to some other device, such as a printer or MIDI device. FIG. 14 shows how the software 58 uses a familiar windowed interface to allow the user to open, save, and restore customized profiles. FIG. 14 depicts the familiar Microsoft Windows™ desktop, although many other operating environments can also support the software of the present invention.

As stated, the simple black line in FIGS. 3, 10, and 14 could also be replaced with a substantially more detailed representation of the train layout, potentially including accessories and/or other types of landmarks. In light of the potential complexity of multiple cabs navigating multiple sections of track, some users may find a color-coded screen interface easier to understand and use. As stated, the commonly available visual compilers meant to be used with the present invention allow for a variety of image backgrounds within user menus and would not have difficulty in supporting such a color-coded arrangement. A browser type of arrangement could also be employed for the user interface.

Additionally, it is intentional that the single cab, single solenoid embodiments described above make use of the parallel port's data port and control port, but do not use the status port. This is significant because it is difficult to write only to selected bits of a PC port. During a port write operation, it is usually necessary to overwrite the entire byte. It is true that a PC port's data can be saved and then masked with new data, so as to allow the changing of only one bit if desired. However, it is preferred to not overwrite the PC port at all if possible, particularly when these ports are in use by an application, such as the software 58. Thus, it is desired to use the data port only for data operations, and the control port only for control operations, and to avoid changing the port values, where possible. In the present invention, the status port was deliberately reserved from being used for these purposes. The status port, despite the naming convention, will be used not for status, but for addressing multiple devices as will now be discussed.

Multiple Cab/Solenoid Controls: Multiplexed Output

Various configurations in which multiple cabs can be controlled were described in the Background of the Invention. Some of these implementations have all rails at the same electrical potential, but distinguish which cab is to be the recipient of power delivery via encoded pulses which are decoded by processors installed inside the moving cab, near the motor. Another way to achieve this is to insulate the rails using non-conductive materials for rail joiners. This enables different sections of track to have varying electrical potential. In either case, the purpose is to enable multiple trains to travel at widely varying speeds and directions. This has the effect of allowing the operator to provide a more entertaining and realistic operation of the model train set.

Figure 12:
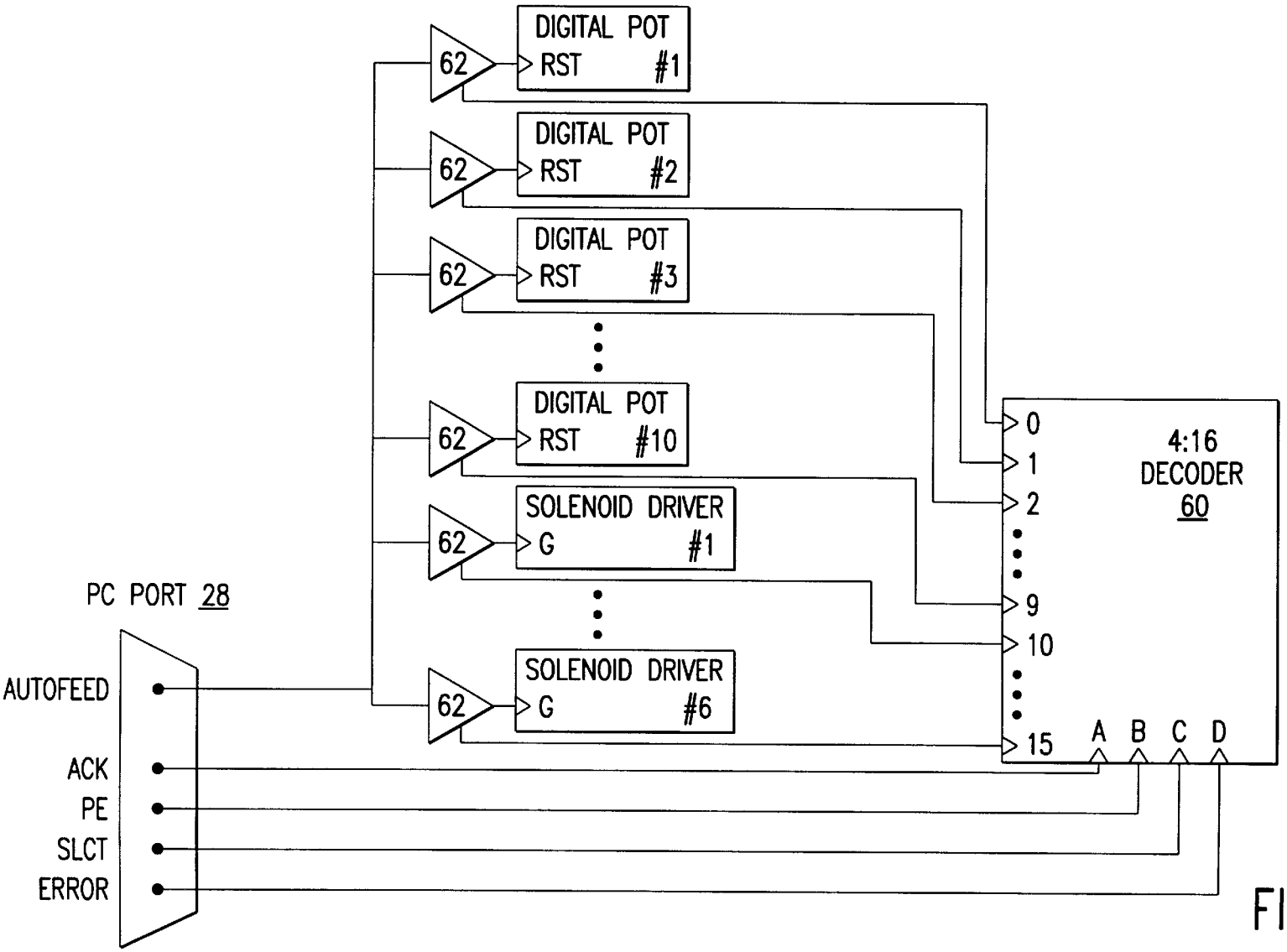
FIG. 12 shows a block diagram of a multi-mb, multi-solenoid embodiment connected to a PC port.

In the standard, unmodified model train configurations meant to be used with the present invention, power is delivered to the cab 16 through the rails 12 only. Thus, the rails 12, by themselves, can deliver only a single amount of power and direction. It is true that more than one cab 16 can simultaneously occupy a set of rails 12, but as cab impedances vary widely, it is unpredictable which cab 16 will draw more power. It is also unpredictable when one of a plurality of occupying cabs 16 will leave a set of rails 12. Thus, with the standard, unmodified train configurations, enabling multiple trains to travel at widely varying speeds and directions requires that the rails be electrically insulated from each other. FIG. 12 shows a more sophisticated layout, employing a system for simultaneously controlling blocks of rails and turnouts to achieve multiple cab control.

In a multiple cab, multiple track section environment, several motor drivers 30 and solenoid drivers 52 are grouped together and multiplexed at the output of PC port 28 as shown in FIG. 12. This configuration is the same as in FIGS. 5 and 11 in that all data, whether bound for motors or solenoids, is still clocked out of computer port pin D0. Also like FIGS. 5 and 11, AUTOFEED being set low still indicates that a data byte is present and about to be clocked in, and STROBE is still set low to clock in each bit of a data byte.

However, the multiple cab, multiple turnout configuration shown in FIG. 12 differs from the single cab, single turnout configuration in FIGS. 5 and 11 in that all drivers are connected to tri-state buffers 62, which are activated by a 4:16 decoder 60. Thus, the present invention only delivers data when a 4:16 decoder 60 detects a specific driver's address and then enables a tri-state buffer 62 connected to that driver. One example of such a decoder is the Fairchild Semiconductor MM74HC154.

Such an addressing scheme is necessitated by the increased complexity arising from multiple cab and solenoid drivers sharing the same data and control lines. It is important to ensure that databytes are delivered to their intended driver only, and to no other devices. It is also important that no motor driver is accidentally disabled or reconfigured by an errant databyte.

The addressing scheme of the present invention uses the ACK (MSB), PE, SLCT, and ERROR (LSB) bits of the status port to act as a 4-bit addressing scheme, and is thus able to effectively address 16 devices. The example shown in FIG. 12 suggests ten digital pot/motor drivers 30 and six solenoid drivers 52, but is not intended to be exhaustive or to limit the present invention to the precise form disclosed. The 4:16 decoder 60 decodes the addressing bits and then enables the tri-state buffer 62 connected to the appropriate motor driver 30 or solenoid driver 52.

For clarity, FIG. 12 does not show the drivers as being connected to actual motors and solenoids, as these details are the same as in FIGS. 5 and 11. Similarly, the connection between the PC port and the PHASE pin of the motor driver 30 is also not shown. The PHASE pin, however, is also tristated from the PC port 28 and therefore also only accessible if properly enabled by 4:16 decoder 60.

It is worthwhile to note that the PC port's data pin D0 and control pin STROBE remain directly connected to each of the motor drivers. However, without AUTOFEED to indicate that data is present and ready to be clocked in, any activity on lines D0 and STROBE will be ignored, and will not change the settings of any of the driver circuits. This is true whether referring to the digital potentiometer's RST pin, or to the solenoid driver's G pin. In either case, when AUTOFEED goes low, if the tri-state buffer system prevents a component's RST or G pins from going low accordingly, all other activity will be ignored by that component.

Either during or after installation, the software 58 allows the user to enter the quantity of the turnout solenoids 42 and cabs 16 that will be controlled. The software 58 also allows the user to select a duration of the solenoid drivers 52. If no selection is made, a default setting can be configured. As stated earlier, the software 58 can store, open, and parse pre-programmed data profiles to operate the cabs 16 without user intervention. Such a feature could be useful in setting up and running simulations of actual railroad operations.

Figure 13:
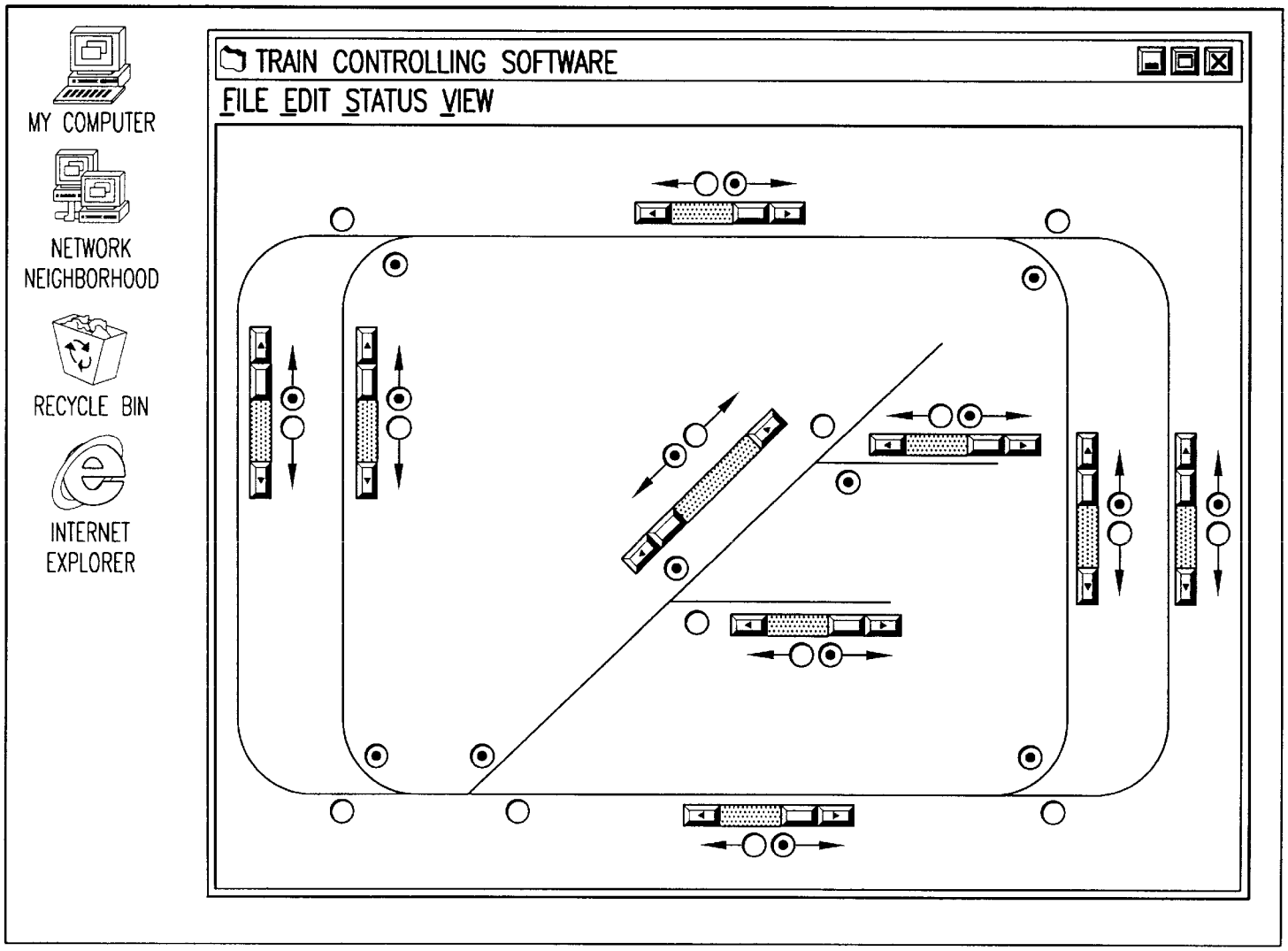
FIG. 13 shows a screen capture of a computer menu displaying an entire model train layout with multiple cabs and multiple solenoids of the present invention.

After installation, during the operation of the software 58, a panel representing all of the cabs 16 and the turnout solenoids 42 is displayed, as shown in FIG. 13. FIG. 13 shows a more complicated layout, with several separate track (cab) sections and also several turnout solenoids 42. Each turnout 42 solenoid is represented by a separate radio button. Each section of track (cab) is represented by a separate slider control, with radio buttons signifying direction.

Figure 15:
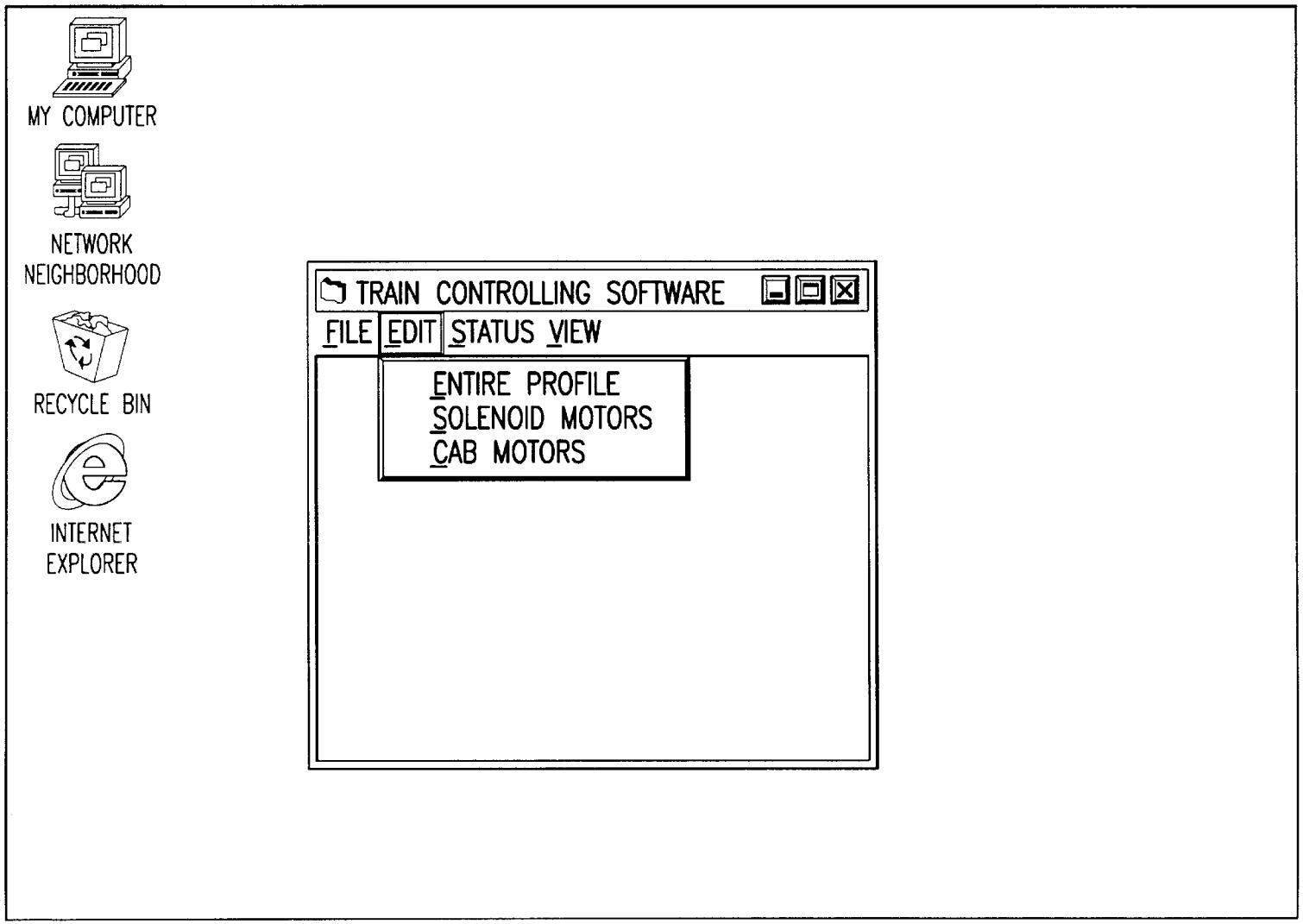
FIG. 15 shows a screen capture of a computer menu of the present invention displaying how software has the ability to modify user profiles.
Figure 16:
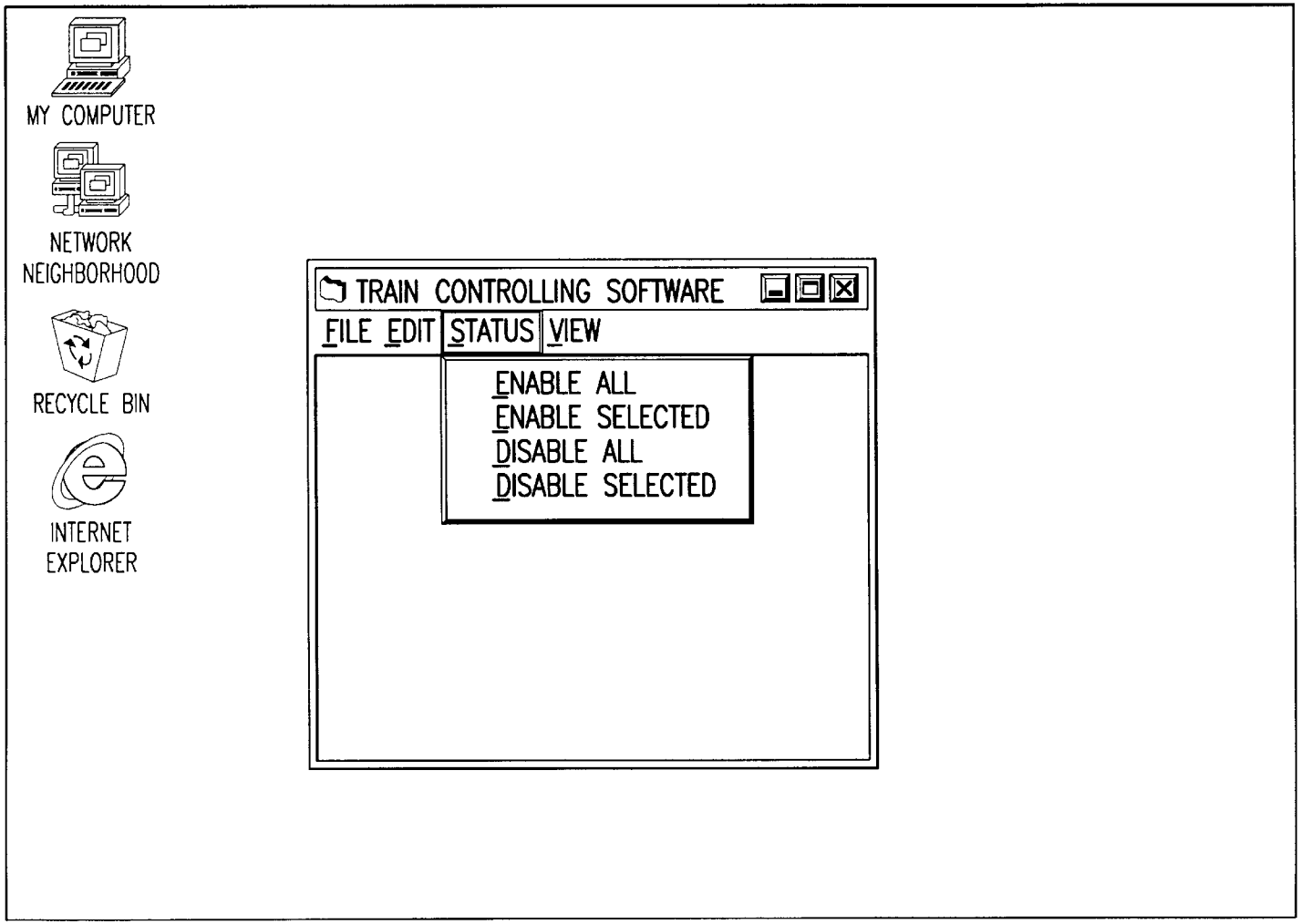
FIG. 16 shows a screen capture of a computer menu of the present invention displaying how software can enable/disable certain sections of a layout within a selection box chosen by the user.
Figure 17:
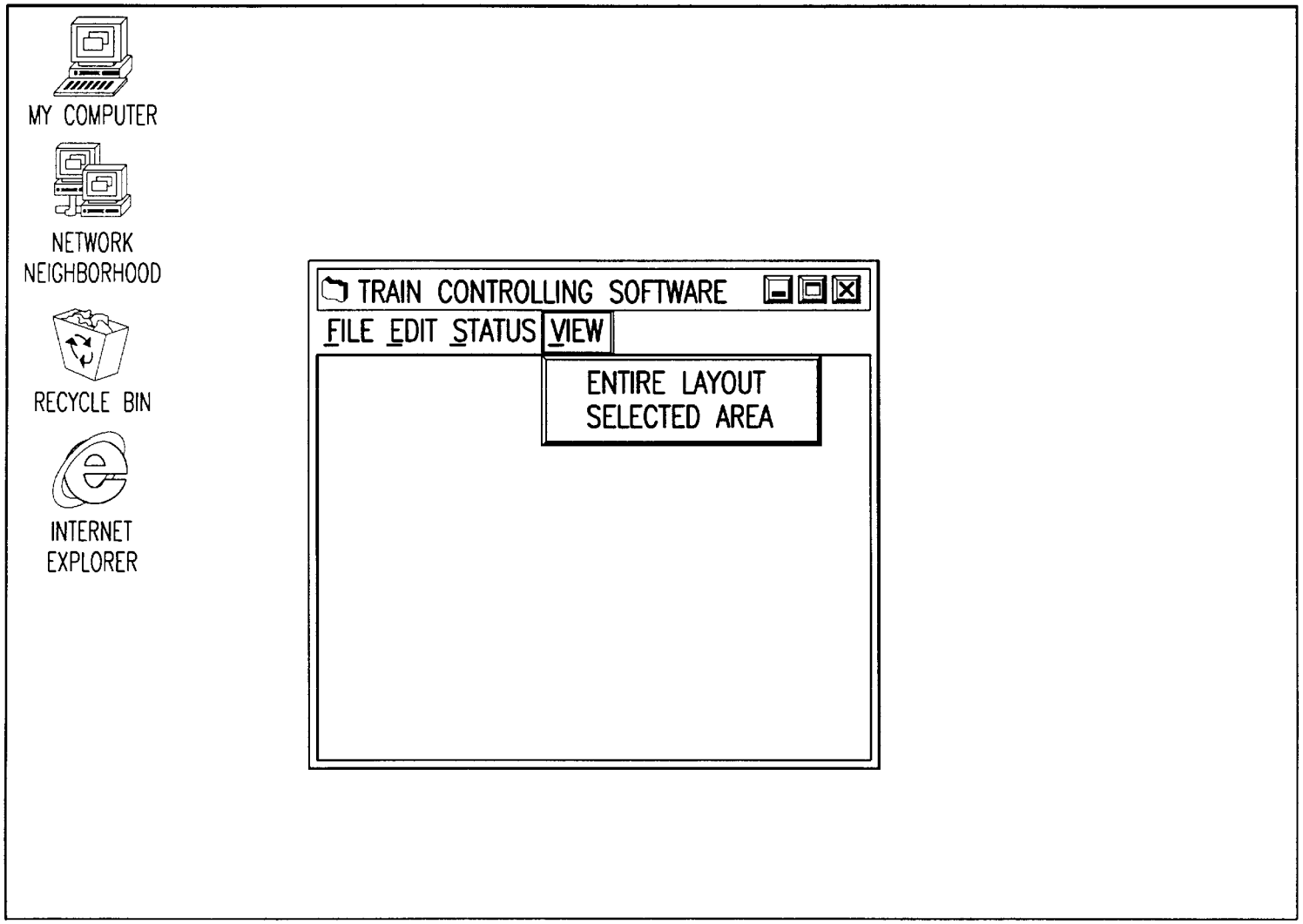
FIG. 17 shows a screen capture of a computer menu of the present invention displaying how software incorporates a "zoom" feature which allows for enlargening certain sections of a layout within a selection box chosen by the user.
Figure 18:
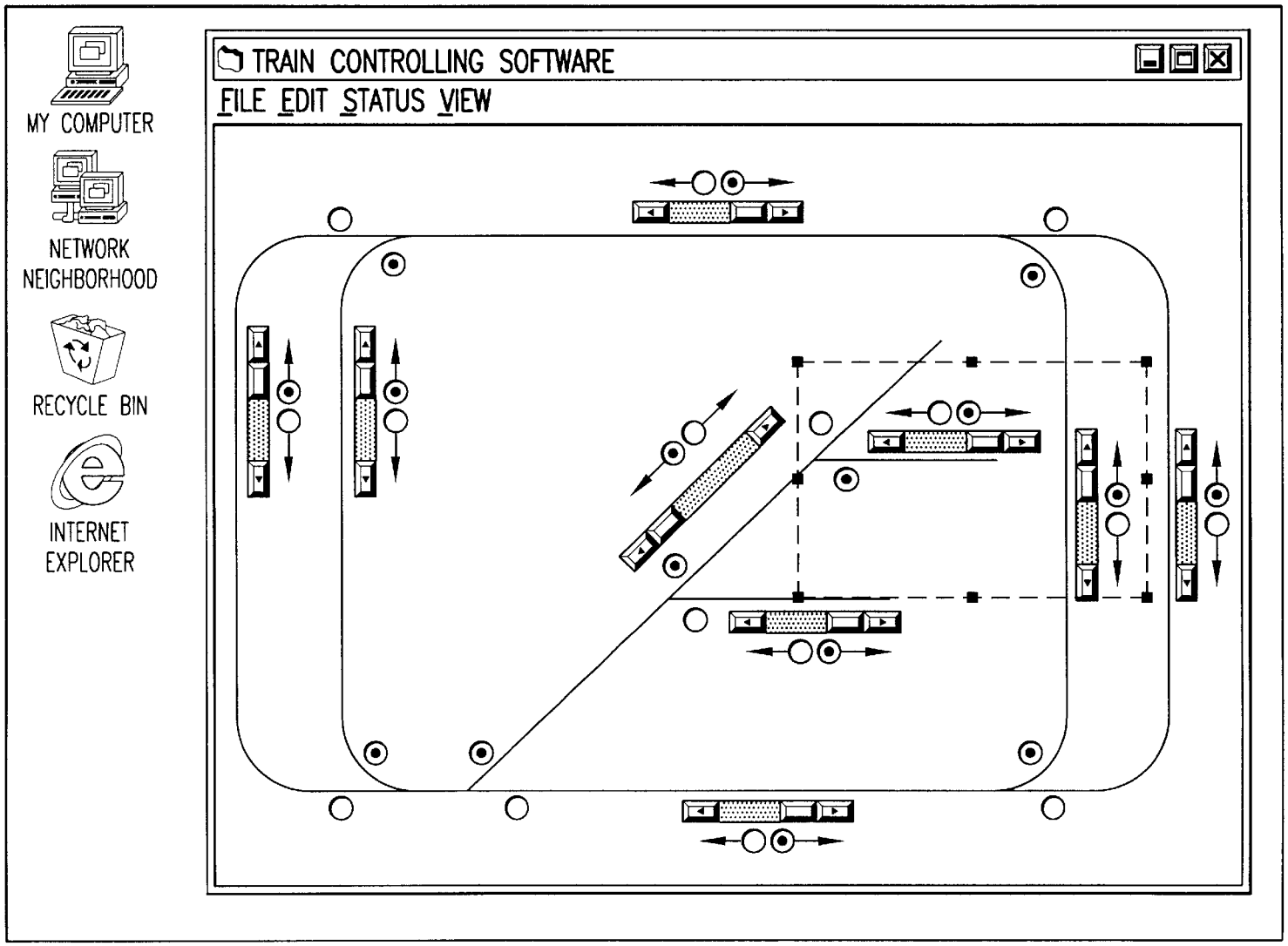
FIG. 18 shows a screen capture of a computer menu of the present invention displaying how software allows the user to select an area to be "zoomed".
Figure 19:
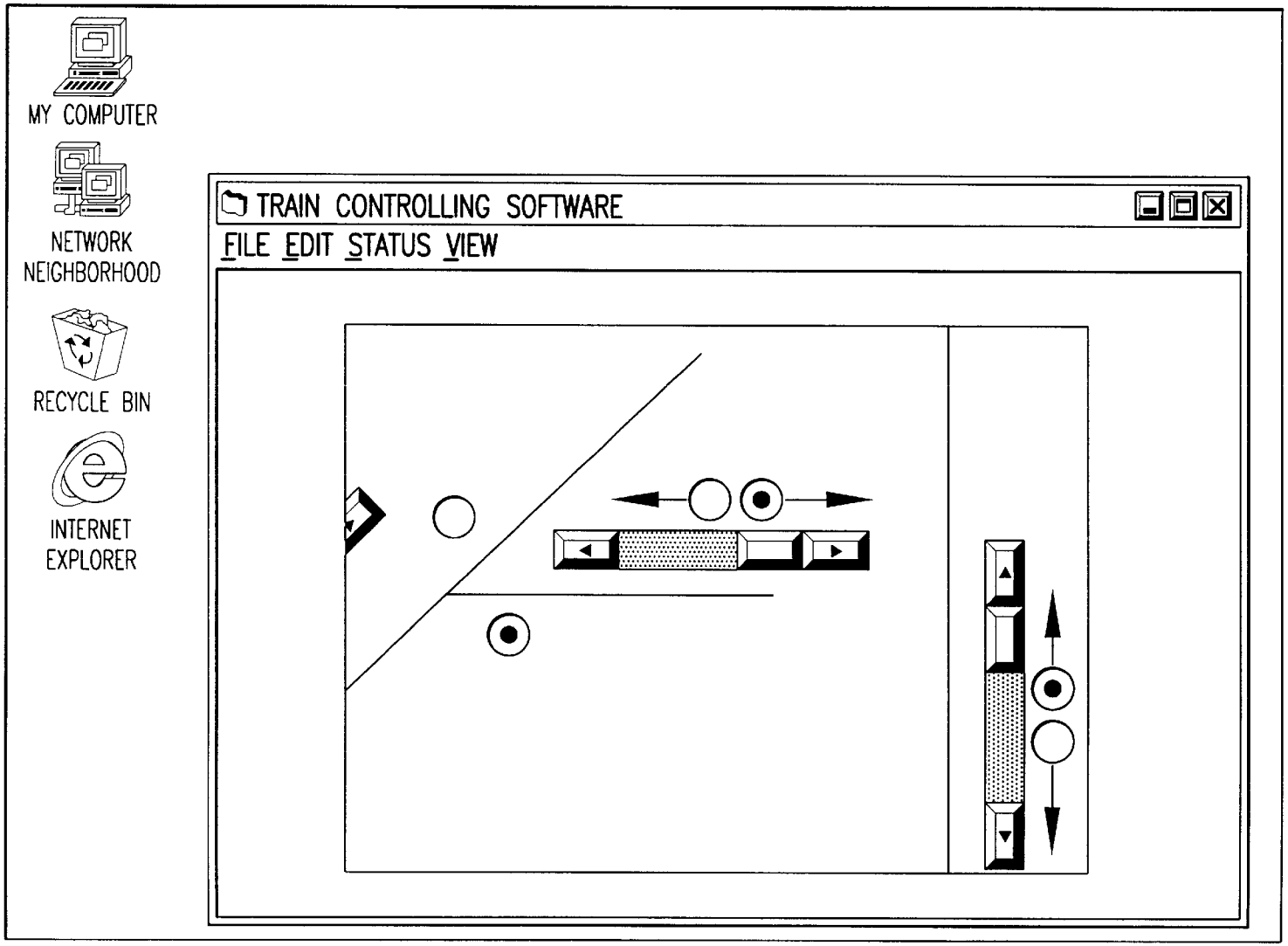
FIG. 19 shows a screen capture of a computer menu of the present invention displaying how software displays the "zoomed" area selected by the user shown in FIG. 18.

FIG. 15 shows how the software 58 allows, for convenience, a user to modify either an entire profile, a profile of the solenoid motors 42 only, or a profile of the cab motors 16 only. FIG. 16 shows how the software 58 can enable/disable certain sections of a layout within a selection box chosen by the user. This can be useful for electrically disabling certain portions of the layout so that repairs can be made, for example, while not interfering with the operation of the non-specified portions of the layout. FIG. 17 shows the potential of a "zoom" feature, which could be useful in managing layout configurations which are too large or detailed to be displayed within one screen panel only. As shown in FIG. 18, software 58 allows the user to select an area of the layout either to be enabled, disabled, or "zoomed". FIG. 19 then shows an example of how the software 58 would then display the "zoomed" area selected by the user.

The visual controls described above can be precompiled into individual classes, and then can be rearranged in the shape of a track layout, such as that shown in FIG. 13. Such configurability and customization is made possible by advances in object oriented programming techniques. In particular, the ability to develop parent classes which can exercise inheritance and/or polymorphism with respect to the precompiled classes enables a user to configure and change objects whenever that user changes the train layout. Thus, a visual representation of a large model train layout can be achieved that is intuitive and easy to use, but still represents all of the electrical details and characteristics of the layout.

The preceding description has been presented only to illustrate and describe the invention. It is not intended to be exhaustive or to limit the invention to any precise form disclosed. Many modifications and variations are possible in light of the above teaching. The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A model train motor and solenoid control apparatus, comprising:

a motor that moves the model train on a plurality of track sections, said track sections having track turnouts;

a solenoid that controls the track turnouts;

a motor driver circuit that connects the train motor to a controller;

a solenoid driver circuit that connects the track turnout solenoid to said controller; and a power circuit for delivering power to said motor through said track sections and said solenoids wherein said controller can be configured to allow a user to enter any one of motor speed, motor direction, and track configuration through a visual user interface;

wherein said visual user interface maintains a visual representation of the operating status of said motors and track sections, said track turnouts, and said motor directions, and is configurable to visually correspond to the physical organization of said track sections within a track layout and how said track sections, turnouts, and motor directions are physically positioned with respect to each other, wherein said visual user interface simultaneously represents the entire overall track layout and exactly corresponds to the physical layout of said track sections, turnouts, and motor directions;

and further wherein a user can view said physical track layout and immediately correlate specific track sections within said physical track layout to portions of said visual user interface, and wherein a user can also view said visual user interface and immediately correlate said interface to specific track sections within said overall track layout.

2. The model train motor and solenoid control apparatus of claim 1, wherein the controller is a computer.

3. The model train motor and solenoid control apparatus of claim 2, wherein a said computer is a programmable computer, further comprising a menued software program that controls one of said motor driver, said solenoid driver, and said power circuit.

4. The model train motor and solenoid control apparatus of claim 3, wherein said menued software program being user-configurable during installation and operation.

5. The model train motor and solenoid control apparatus of claim 4, wherein said user configurability further comprises a user-adjustable solenoid pulse duration.

6. The model train motor and solenoid control apparatus of claim 3, wherein said menued software program further comprises a parallel to serial conversion algorithm that drives an 8-bit databyte through a single dataline.

7. The model train motor and solenoid control apparatus of claim 3, wherein said menued software program allows the storage and retrieval of pre-set data configuration files.

8. The model train motor and solenoid control apparatus of claim 7, wherein said data configuration files enable the setting up and running of simulations of actual railroads.

9. The model train motor and solenoid control apparatus of claim 2, wherein each of said motor driver circuit connection and said solenoid driver circuit connection are through a parallel port of said computer.

10. The model train motor and solenoid control apparatus of claim 9, wherein said menued software program stores data existing at registers of said port at the time said menued software program is initialized, and can restore said port register data at the time said menued software program is exited, thereby enabling said port to be re-used by other processes.

11. The model train motor and solenoid control apparatus of claim 2, wherein each of said motor driver circuit connection and said solenoid driver circuit connection are through one of a joystick port, a game port, a MIDI port, and a music port of said computer.

12. The model train motor and solenoid control apparatus of claim 11, wherein said menued software program stores data existing at registers of said port at the time said menued software program is initialized, and can restore said port register data at the time said menued software program is exited, thereby enabling said port to be used by other processes.

13. The model train motor and solenoid control apparatus of claim 1, wherein said power circuit further comprises a stabilizer circuit.

14. The model train motor and solenoid control apparatus of claim 13, wherein said power circuit further comprises a transformer circuit.

15. The model train motor and solenoid control apparatus of claim 1, wherein said motor driver circuit has pulse capability.

16. The model train motor and solenoid control apparatus of claim 1, wherein said power circuit protects said motor drivers, said solenoid drivers, and said controller from transients and overvoltages.

17. The model train motor and solenoid control apparatus of claim 3, wherein said menued software program permits the user to enable and disable selected portions of said motor and solenoid layout through a user-designated selection portion in coordination with a menued graphical user interface.

18. The model train motor and solenoid control apparatus of claim 3, wherein said menued software program permits the user to zoom-view selected portions of said motor and solenoid layout through a user-designated selection portion in coordination with a menued user interface.

19. The model train motor and solenoid control apparatus of claim 3, wherein said menued software program permits the user to edit either an entire motor and track turnout profile, a motor profile only, or a track turnout profile only.

20. The model train motor and solenoid control apparatus of claim 1, wherein said visual user interface is further configurable so that a visual layout arrangement represented therein can include color coding and graphical representation of accessories and other user-specific layout details.

21. A method for controlling a plurality of model train motors and track turnouts using a controller, comprising:

loading a menued software program on the controller;

connecting said motors and track turnouts to a port of said controller through a motor interface circuit, a track turnout interface circuit, and a power interface circuit;

using said menued software program to configure said port and interface circuits;

operating said motor interface circuit, said track turnout interface circuit, and said power interface circuit connected to said port;

configuring said controller to allow a user to enter any one of motor speed, motor direction, and track configuration through a visual user interface;

wherein said visual user interface maintains a visual representation of the operating status of said motors, said track turnouts, and said motor directions, and is configurable to visually correspond to the physical organization of a plurality of track sections within a track layout and how said track scions, turnouts, and motor directions are physically positioned With respect to each other, wherein said visual user interface simultaneously represents the entire overall track layout and exactly corresponds to the physical layout of said track sections, turnouts, and motor directions;

and further wherein a user could View said physical track layout and immediately correlate specific track sections within said physical track layout to portions of said visual user interface, and wherein a user could also view said visual user interface and immediately correlate said interface to specific track sections within said overall track layout.

22. A model train motor and solenoid control apparatus, comprising:

a controller means having a menued software program loaded therein;

motor driver means for connecting a plurality of said motors to said controller means;

solenoid driver means for connecting a plurality of said solenoids to said controller means;

power supplying means for delivering power to said motor driving means and said solenoid driver means;

wherein said motor driver means, solenoid driver means, and power supplying means are responsive to said menued software program for which is operated by a user through a visual user interface;

wherein said visual user interface maintains a visual representation of the operating status of said motors, said track turnouts, and said motor directions, and is configurable to visually correspond to the physical organization of a plurality of track sections within a track layout and how said track sections, turnouts, and motor directions are physically positioned with respect to each other, wherein said visual user interface simultaneously represents the entire overall track layout and exactly corresponds to the physical layout of said track sections, turnouts, and motor directions;

and further wherein a user could view said physical track layout and immediately correlate specific track sections within said physical track layout to portions of said visual user interface, and wherein a user could also view said visual user interface and immediately correlate said interface to specific track sections within said overall track layout.

23. A menued software program for controlling a model train motor and solenoid, comprising:

a controllable motor that moves the model train;

a controllable solenoid that controls track turnouts;

a motor driver circuit that connects the train motor to a controller;

a solenoid driver circuit that connects the track turnout solenoid to a controller, a power circuit for delivering power to said motors and solenoids; wherein said menued software program is stored in a memory in a controller, and said controller can be configured to allow a user to enter any one of motor speed, motor direction, and track configuration through a visual user interface which corresponds to the physical organization of a plurality of track sections within a track layout and how said track sections, turnouts, and motor directions are physically positioned with respect to each other, wherein said visual user interface simultaneously represents the entire overall track layout and exactly corresponds to the physical layout of said track sections, turnouts and motor directions;

and further wherein a user could view said physical track layout and immediately correlate specific track sections within said physical track layout to portions of said visual user interface, and wherein a user could also view said visual user interface and immediately correlate said interface to specific track sections within said overall track layout.

24. The menued software program of claim 23, wherein said controller is a computer.

25. A model train motor and solenoid control apparatus, comprising:

a motor that moves the model train on a track, said track having track turnouts;

a solenoid that controls the track turnouts;

a motor driver circuit that connects the train motor to a controller;

a solenoid driver circuit that connects the track turnout solenoid to the controller; and a power circuit for delivering power to said motor and said solenoids, said controller being configurable to allow a user to enter any one of motor speed, motor direction, track configuration, and user adjustable solenoid pulse duration through a visual user interface which corresponds to the physical organization of a plurality of track sections within a track layout and how said track cdtions, turnouts, and motor directions are physically positioned with respect to each other, wherein said visual user interface simultaneously represents the entire overall track layout and exactly corresponds to the physical layout of said track sections, turnouts, and motor directions;

and further wherein a user could view said physical track layout and immediately correlate specific track sections within said physical track layout to portions of said visual user interface, and wherein a user could also view said visual user interface and immediately correlate said interface to specific track sections within said overall track layout.

26. A model train motor and solenoid control apparatus, comprising:

a motor that moves the model train on a track, said track having track turnouts;

a solenoid that controls the track turnouts;

a motor driver circuit that connects the train motor to a controller;

a solenoid driver circuit that connects the track turnout solenoid to the controller; and a power circuit for delivering power to said motor and said solenoids, wherein said controller is a programmable computer further comprising a menued software program that controls one of said motor driver, said solenoid driver, and said power circuit, said controller being configurable to allow a user to enter any one of motor speed, motor direction, and track configuration through a graphical user interface; and said menued software program maintains a visual representation of the operating status of said motors, said track turnouts, and said motor directions which corresponds to the physical organization of a plurality of track sections within a track layout and how said track sections, turnouts, and motor directions are physically positioned with respect to each other, wherein said visual user interface simultaneously represents the entire overall track layout and exactly corresponds to the physical layout of said track sections, turnouts, and motor directions;

and further wherein a user could view said physical track layout and immediately correlate specific track sections within said physical track layout to portions of said visual user interface, and wherein a user could also view said visual user interface and immediately correlate said interface to specific track sections within said overall track layout.

27. The model train motor and solenoid control apparatus of claim 20, wherein said visual layout arrangement represented therein includes slider bars to represent' speed of said train, radio buttons to represent direction of said train, and radio buttons to represent direction of said turnouts.

* * * * *